US009677223B2

(12) United States Patent
Chuang et al.

(10) Patent No.: US 9,677,223 B2
(45) **Date of Patent: *Jun. 13, 2017**

(54) CUT-RESISTANT CABLE STRUCTURES AND SYSTEMS AND METHODS FOR MAKING THE SAME

(71) Applicant: Apple Inc., Cupertino, CA (US)

(72) Inventors: Brian L. Chuang, San Francisco, CA (US); Min Chul Kim, San Jose, CA (US); Andrew M. Weidner, San Francisco, CA (US); Adrianne M. Ruggiero, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/093,479

(22) Filed: Apr. 7, 2016

(65) Prior Publication Data

US 2016/0215447 A1 Jul. 28, 2016

Related U.S. Application Data

(63) Continuation of application No. 14/299,351, filed on Jun. 9, 2014, now Pat. No. 9,322,131.

(Continued)

(51) Int. Cl.
*H01B 7/00* (2006.01)
*D07B 1/00* (2006.01)

(Continued)

(52) U.S. Cl.
CPC ..... *D07B 1/005* (2013.01); *D07B 1/0673* (2013.01); *D07B 1/0686* (2013.01); *D07B 1/10* (2013.01);

(Continued)

(58) Field of Classification Search
CPC ... H01B 3/00; H01B 7/00; H01B 9/00; H01B 11/00

(Continued)

(56) References Cited

U.S. PATENT DOCUMENTS 4,317,000 A * 2/1982 Ferer ..... H01B 7/182 138/130
4,365,865 A * 12/1982 Stiles ..... G02B 6/4416 174/70 R (Continued)

FOREIGN PATENT DOCUMENTS

WO 02090693 A 11/2002
WO 2011008568 A2 1/2011
WO 2012160168 A1 11/2012

OTHER PUBLICATIONS

International Search Report & Written Opinion from PCT/US2014/072873, Aug. 25, 2015, 25 pages.

*Primary Examiner* — William H Mayo, III
(74) *Attorney, Agent, or Firm* — Van Court & Aldridge LLP

(57) ABSTRACT

Cable structures of security systems may include multiple subassemblies having different cut-resistant characteristics. One system includes, inter alia, a portable article, a support, and a length of a cable assembly extending between a first cable end coupled to the portable article and a second cable end coupled to the support, where the cable assembly includes a first cable subassembly extending along at least a portion of the length of the cable assembly, and a second cable subassembly extending along at least the portion of the length of the cable assembly and adjacent to the first cable subassembly, and where the first cable subassembly includes a first cut resistant characteristic and the second cable (Continued)

subassembly includes a second cut resistant characteristic that is different than the first cut resistant characteristic.

57 Claims, 8 Drawing Sheets

Related U.S. Application Data

(60) Provisional application No. 61/922,550, filed on Dec. 31, 2013.

(51) Int. Cl.

| | |
|---|---|
| ***D07B 1/10*** | (2006.01) |
| ***D07B 1/14*** | (2006.01) |
| ***E05B 73/00*** | (2006.01) |
| ***D07B 1/06*** | (2006.01) |
| ***D07B 1/16*** | (2006.01) |
| ***H01B 7/04*** | (2006.01) |

(52) U.S. Cl.
CPC ..... *D07B 1/147* (2013.01); *D07B 1/16* (2013.01); *E05B 73/0005* (2013.01); *E05B 73/0011* (2013.01); *H01B 7/041* (2013.01); *D07B 2201/104* (2013.01); *D07B 2201/1064* (2013.01); *D07B 2201/1068* (2013.01); *D07B 2201/2057* (2013.01); *D07B 2201/2061* (2013.01); *D07B 2205/205* (2013.01); *D07B 2205/2096* (2013.01); *D07B 2401/20* (2013.01)

(58) Field of Classification Search
USPC ..... 174/110 R, 113 R, 102 R, 108, 109, 174/106 R
See application file for complete search history.

(56) References Cited

U.S. PATENT DOCUMENTS

| | | | | |
|---|---|---|---|---|
| 5,921,285 | A * | 7/1999 | Quigley | D04C 1/06 138/114 |
| 6,336,826 | B1 * | 1/2002 | Kraft | H01R 13/6463 439/498 |
| 7,132,952 | B2 | 11/2006 | Leyden et al. | |
| 7,592,548 | B2 | 9/2009 | Marszalek et al. | |
| 8,418,327 | B2 | 4/2013 | Woods | |
| 2005/0134458 | A1 | 6/2005 | Leyden et al. | |
| 2005/0199414 | A1 * | 9/2005 | Kim | H01B 9/006 174/110 R |
| 2006/0001541 | A1 * | 1/2006 | Leyden | G08B 13/149 340/568.2 |
| 2007/0154052 | A1 * | 7/2007 | Gantz | H04R 1/1033 381/384 |
| 2012/0043936 | A1 | 2/2012 | Ferguson | |
| 2012/0064845 | A1 * | 3/2012 | Smith | H04M 1/05 455/90.2 |
| 2012/0176243 | A1 | 7/2012 | Andersen | |
| 2013/0161054 | A1 | 6/2013 | Allison et al. | |
| 2013/0168527 | A1 | 7/2013 | Wheeler et al. | |

* cited by examiner

800

CUT-RESISTANT CABLE STRUCTURES AND SYSTEMS AND METHODS FOR MAKING THE SAME

CROSS-REFERENCE TO RELATED APPLICATION(S)

This application is a continuation of U.S. patent application Ser. No. 14/299,351 filed Jun. 9, 2014 (now U.S. Pat. No. 9,322,131), which claims the benefit of prior filed U.S. Provisional Patent Application No. 61/922,550, filed Dec. 31, 2013, each of which is hereby incorporated by reference herein in its entirety.

FIELD OF THE INVENTION

This can relate to cut-resistant cable structures and, more particularly, to cable structures with multiple subassemblies having different cut-resistant characteristics, and systems and methods for making the same.

BACKGROUND OF THE DISCLOSURE

A conventional cable used for securing two elements to one another typically includes one or more stainless steel wires extending along the length of the cable. Such an arrangement of one or more stainless steel wires provides the cable with a certain amount of resistance to cutting by a cutting tool of a potential thief, while still enabling the cable to be flexible and electrically conductive. Nevertheless, such an arrangement of one or more stainless steel wires is often able to be cut when a certain amount of cutting force is applied. Accordingly, alternative arrangements for making a cable cut-resistant are needed.

SUMMARY OF THE DISCLOSURE

Cut-resistant cable structures and systems and methods for making the same are provided.

For example, in some embodiments, there is provided a system that includes a portable article, a support, and a length of a cable assembly extending between a first cable end coupled to the portable article and a second cable end coupled to the support. The cable assembly includes a first cable subassembly extending along at least a portion of the length of the cable assembly and a second cable subassembly extending along at least the portion of the length of the cable assembly and adjacent to the first cable subassembly. The first cable subassembly includes a first cut-resistant characteristic, and the second cable subassembly includes a second cut-resistant characteristic that is different than the first cut-resistant characteristic.

In other embodiments, there is provided a cable assembly that includes a first cable subassembly extending along at least a portion of a length of the cable assembly and a second cable subassembly extending along at least the portion of the length of the cable assembly and adjacent to the first cable subassembly. The first cable subassembly includes a number of fibers extending along the portion of the length of the cable assembly. Each fiber of the number of fibers includes a first cross-sectional thickness. The second cable subassembly includes a number of wires extending along the portion of the length of the cable assembly. The second cable subassembly includes a number of wire groupings. Each wire grouping of the number of wire groupings includes a sub-grouping of wires of the number of wires. Each wire of the number of wires includes a second cross-sectional thickness that is greater than the first cross-sectional thickness. At least one wire grouping of the number of wire groupings surrounds a cross-sectional outer periphery of at least a portion of the first cable subassembly.

In yet other embodiments, there is provided a method of forming a cable that includes twisting a number of fibers in a first lay direction along a longitudinal axis of the cable and twisting a number of wires about the twisted number of fibers in a second lay direction along the longitudinal axis of the cable.

This Summary is provided merely to summarize some example embodiments, so as to provide a basic understanding of some aspects of the subject matter described in this document. Accordingly, it will be appreciated that the features described in this Summary are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters may refer to like parts throughout, and in which.

DETAILED DESCRIPTION OF THE DISCLOSURE

Cut-resistant cable structures and systems and methods for making the same are provided and described with reference to FIGS. 1-8.

Figure 1:
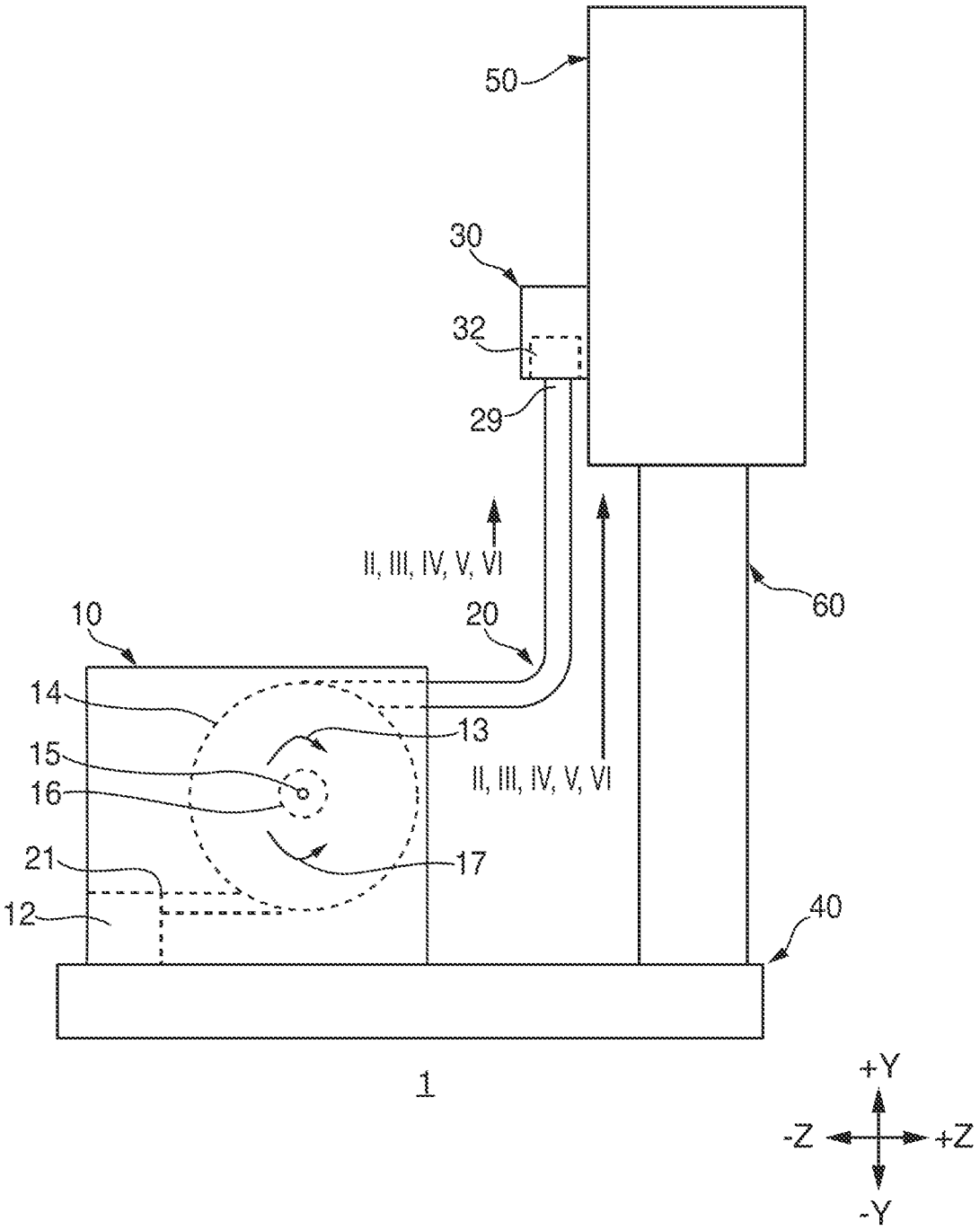
FIG. 1 is a perspective view of a system that includes a cut-resistant cable structure, in accordance with some embodiments of the invention.

A cut-resistant cable structure may be provided as part of any suitable cabled system. For example, as shown in FIG. 1, a system 1 may include a cable 20 that can securely couple a support 40 to a portable article 50. Cable 20 may be purely mechanical for physically coupling support 40 to article 50. Alternatively, cable 20 may be electromechanical for also enabling the conduction of an electrical signal, as described in more detail below. In any event, cable 20 may be provided with any suitable length between support 40 and article 50 that may permit a user to grab and move article 50 (e.g., a portable electronic device, such as an iPhone™ made available by Apple Inc. of Cupertino, Calif.) with respect to support 40 (e.g., a table or any other suitable relatively fixed structure). System 1 may also include a stand 60 on which article 50 may be perched when not being held by a user. Such a system 1 may be used in a retail store or other suitable environment where it may be desirable to secure article 50 while also allowing article 50 to be handled by a user.

As also shown in FIG. 1, in some embodiments, system 1 may also include a support connector 10 that may be coupled to support 40 and a first cable end 21 of cable 20, such that cable 20 may be coupled to support 40 via support connector 10 rather than directly to support 40. Additionally or alternatively, as also shown in FIG. 1, system 1 may also include an article connector 30 that may be coupled to article 50 and a second cable end 29 of cable 20, such that cable 20 may be coupled to article 50 via article connector 30 rather than directly to article 50. Support connector 10 may include a retractor component 14 that may be configured to retract at least a certain portion of the length of cable 20 (e.g., into a housing of support connector 10). For example, retractor component 14 may include a reel mechanism with a hub 16 about which a portion of cable 20 may be wound. Hub 16 may be configured to rotate about an axis 15 in a first direction 13 for releasing a longer length of cable 20 out from support connector 10 (e.g., for elongating the length of cable 20 extending between support 40 and article 50 that may be manipulated by a user pulling on cable 20) and in a second direction 17 for pulling a longer length of cable 20 into support connector 10 (e.g., for shortening the length of cable 20 extending between support 40 and article 50 when a user is not pulling on cable 20). In some embodiments, first cable end 21 may be coupled to hub 16 of retractor component 14. Alternatively, as shown in FIG. 1, first cable end 21 of cable 20 may be coupled to a first alarm subcomponent 12 of system 1 (e.g., within a housing of support connector 10) and second cable end 29 of cable 20 may be coupled to a second alarm subcomponent 32 of system 1 (e.g., within a housing of article connector 30). One of first alarm subcomponent 12 and second alarm subcomponent 32 may be configured to generate and transmit a signal through a conductive portion of the length of cable 20 to the other one of first alarm subcomponent 12 and second alarm subcomponent 32, which may be configured to determine when the transmission of the signal has been interrupted (e.g., when cable 20 has been at least partially cut such that the signal is no longer able to be conducted appropriately through cable 20) and then to generate an alarm in response to such a determination.

FIG. 2 and FIG. 2A

Figure 2:
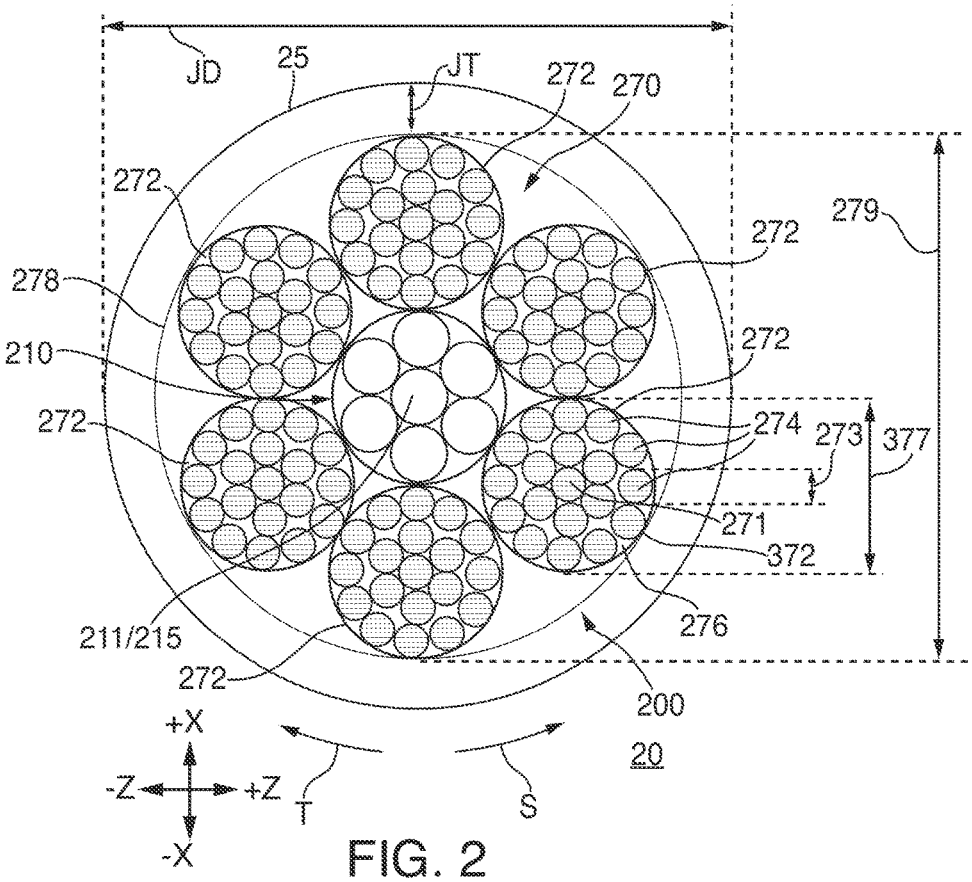
FIG. 2 is a cross-sectional view of the cable structure of FIG. 1, taken from line II-II of FIG. 1, in accordance with some embodiments of the invention.

Cable 20 may be configured to be flexible enough to allow easy user-manipulation of the position of article 50 and/or to bend about hub 16 for retraction purposes, but also to be strong enough to resist attempts by a would-be thief at cutting through cable 20 for de-coupling article 50 from support 40. For example, the bend radius of cable 20 may be any suitable magnitude, such as a magnitude in a range between 10 millimeters and 16 millimeters, or, more particularly, a magnitude in a range between 12 millimeters and 14 millimeters, or, more particularly, a magnitude about or equal to 13 millimeters. For example, the minimum radius of hub 16 about which cable 20 may bend without kinking or otherwise being damaged may be about or equal to 13 millimeters. Moreover, cable 20 may be configured to have a particular outer cross-sectional thickness. For example, as shown in FIG. 2, cable 20 may include a cut-resistant cable structure 200 that may be surrounded by a jacket 25 along at least a portion of the length of cable 20, where jacket 25 may be configured to provide cable 20 with an outer cross-sectional thickness JD, which may be any suitable magnitude, such as a magnitude in a range between 2.9 millimeters and 3.5 millimeters, or, more particularly, a magnitude in a range between 3.1 millimeters and 3.3 millimeters, or, more particularly, a magnitude about or equal to 3.17 millimeters. Jacket 25 may be disposed around cut-resistant cable structure 200 along a length of cable 20 (e.g., from first cable end 21 to second cable end 29). Jacket 25 may be any suitable insulating and/or conductive material that may be extruded or otherwise provided about cut-resistant cable structure 200 for protecting cut-resistant cable structure 200 from certain environmental threats (e.g., impact damage, debris, heat, fluids, and the like) and/or for at least partially defining the look and feel of cable 20. For example, jacket 25 may be a thermoplastic copolyester ("TPC") (e.g., Arnitel™ XG5857) or a copolymer (e.g., fluorinated ethylene propylene ("FEP")) or any other suitable material or combination of materials, which may be extruded or otherwise provided around the outer periphery of cut-resistant cable structure 200 (e.g., around outer periphery 278 of outer cable subassembly 270 of cut-resistant cable structure 200 as described in more detail below). Jacket 25 may be provided around the outer periphery of cut-resistant cable structure 200 with any suitable thickness JT, which may be any suitable magnitude, such as a magnitude in a range between 0.25 millimeters and 0.45 millimeters, or, more particularly, a magnitude in a range between 0.3 millimeters and 0.4 millimeters, or, more particularly, a magnitude about or equal to 0.34 millimeters. As shown, jacket 25 may provide an overall diameter or any other suitable cross-sectional width or thickness JD for cable 20.

As shown in FIG. 2, cut-resistant cable structure 200 may include an inner cable subassembly 210 and an outer cable subassembly 270 surrounding inner cable subassembly 210 along at least a portion of the length of cable 20. Inner cable subassembly 210 and outer cable subassembly 270 may be configured to have different cut-resistant characteristics, such that each subassembly may pose different challenges to a would-be thief. For example, inner cable subassembly 210 may be configured to have a first cut-resistant characteristic, while outer cable subassembly 270 may be configured to have a second cut-resistant characteristic that is different than the first cut-resistant characteristic. In some embodiments, the first cut-resistant characteristic may be more resistant to a shear cutter than the second cut-resistant characteristic may be to the shear cutter, for example, where such a shear cutter may include any suitable cutting tool with blades that slide against each other to cut through an object (e.g., scissors). Additionally or alternatively, the first cut-resistant characteristic may be less resistant to a precision cutter than the second cut-resistant characteristic may be to the precision cutter, for example, where such a precision cutter may include any suitable cutting tool with blades that abut each other to cut through an object (e.g., guillotine cutters, wire snips, etc.). Such a configuration may enable cable structure 200 to more effectively provide a cut-resistant cable 20 that may require a would-be thief to use at least two different types of cutting tools to cut through cable 20.

Figure 2A:
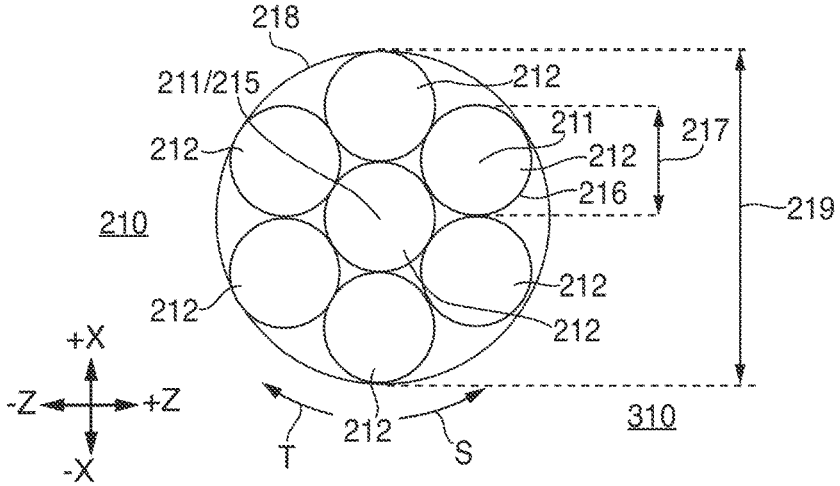
FIG. 2A is a cross-sectional view, similar to FIG. 2, of a portion of the cable structure of FIGS. 1 and 2, in accordance with some embodiments of the invention.

Inner cable subassembly 210 may include any suitable amount of material or combinations of material organized in any suitable manner. For example, as shown in FIGS. 2 and 2A, inner cable subassembly 210 may include one or more inner bundles 212 of material or combinations of material, where each inner bundle 212 may include a longitudinal axis 211 along which the material of that bundle 212 may extend through at least a portion of the length of cable 20 within an outer periphery 216 of that bundle 212. As shown, inner cable subassembly 210 may include seven inner bundles 212, such that six inner bundles 212 extend adjacent to and along the outer periphery 216 of a seventh central inner bundle 212 whose longitudinal axis 211 may be common with a central longitudinal axis 215 of inner cable subassembly 210. While each inner bundle 212 may include material within its own outer periphery 216, the six non-central inner bundles 212 may be positioned to surround the outer periphery 216 of the seventh central inner bundle 212, and portions of the outer periphery 216 of each of the six non-central inner bundles 212 may combine to define an outer periphery 218 of inner cable subassembly 210. It is to be understood that any suitable number of inner bundles 212 may be provided by inner cable subassembly 210, including just one inner bundle 212 or more than seven inner bundles 212. In some embodiments, the material composition of each individual inner bundle 212 may be twisted in a particular lay direction about its own bundle longitudinal axis 211. For example, as shown in FIG. 2A, each inner bundle 212 of inner cable subassembly 210 may be twisted in a first lay direction S (e.g., a counter-clockwise lay direction about its axis 211). Additionally or alternatively, the six non-central inner bundles 212 may be twisted in a particular lay direction about bundle longitudinal axis 211/215 of the seventh central inner bundle 212. For example, as shown in FIG. 2A, the six non-central inner bundles 212 of inner cable subassembly 210 may be twisted in either a first lay direction S or a second lay direction T (e.g., a clockwise lay direction) about central axis 215.

Inner cable subassembly 210 may be configured to have any suitable dimensions. For example, as shown in FIG. 2A, inner cable subassembly 210 may have an outer periphery 218 with an outer periphery cross-sectional thickness 219, which may be any suitable magnitude, such as a magnitude in a range between 0.69 millimeters and 0.99 millimeters, or, more particularly, a magnitude in a range between 0.80 millimeters and 0.88 millimeters, or, more particularly, a magnitude about or equal to 0.84 millimeters. Inner cable subassembly 210 may be disposed along any suitable portion of the length of cable 20 (e.g., any suitable portion or the entirety of the length of cable 20 from first cable end 21 to second cable end 29). If inner cable subassembly 210 includes only a single inner bundle 212, than the outer periphery 216 of that inner bundle 212 may share the same geometry as outer periphery 218. However, if, for example, inner cable subassembly 210 includes seven inner bundles 212, as shown in FIG. 2A, an inner bundle 212 may have an outer periphery 216 with an outer periphery cross-sectional thickness 217, which may be any suitable magnitude, such as a magnitude in a range between 0.23 millimeters and 0.33 millimeters, or, more particularly, a magnitude in a range between 0.27 millimeters and 0.29 millimeters, or, more particularly, a magnitude about or equal to 0.28 millimeters. Each inner bundle 212 may be disposed along any suitable portion of the length of cable 20 (e.g., any suitable portion or the entirety of the length of cable 20 from first cable end 21 to second cable end 29).

Figure 7:
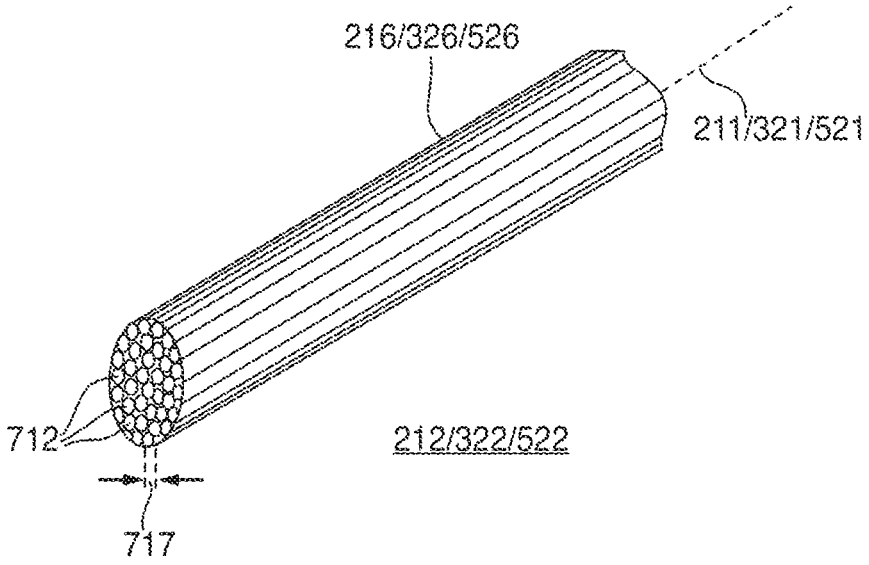
FIG. 7 is a perspective view of a portion of a subassembly of the cable structure of one or more of FIGS. 1-5, in accordance with some embodiments of the invention.

Each inner bundle 212 may have any suitable material composition for providing a first cut-resistant characteristic to cable structure 200. For example, each inner bundle 212 may include a bundle of individual fibers extending along longitudinal axis 211 of that bundle 212. For example, as shown in FIG. 7, an inner bundle 212 may include any suitable number of individual fibers 712 that may extend along longitudinal axis 211 of that bundle 212 within outer periphery 216 of that bundle 212. As shown, each individual fiber 712 may have a diameter or cross-sectional thickness 717, which may be any suitable magnitude, such as a magnitude in a range between 0.005 millimeters and 0.025 millimeters, or, more particularly, a magnitude in a range between 0.012 millimeters and 0.018 millimeters, or, more particularly, a magnitude about or equal to 0.015 millimeters. Any suitable number of fibers 712 may be packed within outer periphery 216 of its bundle 212 with any suitable density (e.g., linear mass density), such as a density in a range between 700 Deniers and 900 Deniers, or, more particularly density about or equal to 800 Deniers. Each fiber 712 may be made of any suitable material or combination of materials for providing the first cut-resistant characteristic to cable structure 200. For example, in some embodiments, each fiber 712 may be any suitable aramid fiber, such as a para-aramid synthetic fiber (e.g., Kevlar™ provided by DuPont of Wilmington, Del. or Twaron™ provided by Teijin of Osaka, Japan), or a meta-aramid (e.g., Nomex™ provided by DuPont), a copolyamide (e.g., Technora™ provided by Teijin), any suitable thermoset liquid crystalline polyoxazole (e.g., Zylon™ provided by Toyobo Corporation of Osaka, Japan), any other suitable material, and/or any suitable combination thereof. By configuring one or more inner bundles 212 of inner cable subassembly 210 of cable structure 200 of FIG. 2 to include such a density of such fibers 712, inner cable subassembly 210 may provide cable structure 200 with a first cut-resistant characteristic that is particularly resistant to shear cutters, for example, as the fineness and flexibility of such fibers may conform about the blades of such shear cutters without being cut.

With continued reference to FIG. 2, outer cable subassembly 270 may be configured to extend adjacent to and/or surround outer periphery 218 of inner cable subassembly 210 (e.g., for providing cable structure 200 with a second cut-resistant characteristic that is different than the first cut-resistant characteristic of inner cable subassembly 210). As shown, outer cable subassembly 270 may include at least one wire 274 that may extend along at least a portion of the length of cable 20 and adjacent to inner cable subassembly 210. In some embodiments, outer cable subassembly 270 may include only a single wire 274 and, in other embodiments, outer cable subassembly 270 may include two or more wires 274. As shown in FIG. 2, for example, outer cable subassembly 270 may include one or more outer bundles 272 of two or more wires 274, where each outer bundle 272 may include a longitudinal axis 271 along which the wires 274 of that bundle 272 may extend through at least a portion of the length of cable 20 within an outer periphery 276 of that bundle 272. As shown, outer cable subassembly 270 may include six outer bundles 272, each of which may extend adjacent to and along the outer periphery 218 of inner cable subassembly 210 and central longitudinal axis 215 of inner cable subassembly 210. While each outer bundle 272 may include two or more wires 274 within its own outer periphery 276, the six outer bundles 272 may be positioned to surround the outer periphery 218 of inner cable subassembly 210 and portions of the outer periphery 276 of each of the outer bundles 272 may combine to define an outer periphery 278 of outer cable subassembly 270. It is to be understood that any suitable number of outer bundles 272 may be provided by outer cable subassembly 270, including just one outer bundle 272 or more than six outer bundles 272. In some embodiments, the material composition (e.g., the wires 274) of each individual outer bundle 272 may be twisted in a particular lay direction about its own bundle longitudinal axis 271. For example, as shown in FIG. 2, each outer bundle 272 of outer cable subassembly 270 may be twisted in a first lay direction S (e.g., a counter-clockwise lay direction about its axis 271). Additionally or alternatively, the six outer bundles 272 may be twisted in a particular lay direction about central longitudinal axis 211/215 of inner cable subassembly 210. For example, as shown in FIG. 2, the six outer bundles 272 of outer cable subassembly 270 may be twisted in either a first lay direction S or a second lay direction T (e.g., a clockwise lay direction) about central axis 215.

Outer cable subassembly 270 may be configured to have any suitable dimensions. For example, as shown in FIG. 2, outer cable subassembly 270 may have an outer periphery 278 with an outer periphery cross-sectional thickness 279, which may be any suitable magnitude, such as a magnitude in a range between 2.1 millimeters and 2.9 millimeters, or, more particularly, a magnitude in a range between 2.3 millimeters and 2.7 millimeters, or, more particularly, a magnitude about or equal to 2.5 millimeters. Outer cable subassembly 270 may be disposed along any suitable portion of the length of cable 20 (e.g., any suitable portion or the entirety of the length of cable 20 from first cable end 21 to second cable end 29). If outer cable subassembly 270 includes only a single wire 274, than the cross-sectional thickness (e.g., thickness 273) of that wire 274 may share the same geometry as outer periphery 278. However, if, for example, outer cable subassembly 270 includes one or more bundles 272 of two or more wires 274, as shown in FIG. 2, an outer bundle 272 may have an outer periphery 276 with an outer periphery cross-sectional thickness 277, which may be any suitable magnitude, such as a magnitude in a range between 0.51 millimeters and 1.19 millimeters, or, more particularly, a magnitude in a range between 0.68 millimeters and 1.02 millimeters, or, more particularly, a magnitude about or equal to 0.85 millimeters. Each outer bundle 272 may be disposed along any suitable portion of the length of cable 20 (e.g., any suitable portion or the entirety of the length of cable 20 from first cable end 21 to second cable end 29).

Each outer bundle 272 may have any suitable material composition for providing a second cut-resistant characteristic to cable structure 200. For example, each outer bundle 272 may include a bundle of individual wires 274 extending along longitudinal axis 271 of that bundle 272. For example, as shown in FIG. 2, an outer bundle 272 may include any suitable number of individual wires 274 (e.g., nineteen wires 274) that may extend along longitudinal axis 271 of that bundle 272 within outer periphery 276 of that bundle 272. As shown, each individual wire 274 may have a diameter or cross-sectional thickness 273, which may be any suitable magnitude, such as a magnitude in a range between 0.13 millimeters and 0.21 millimeters, or, more particularly, a magnitude in a range between 0.15 millimeters and 0.19 millimeters, or, more particularly, a magnitude about or equal to 0.17 millimeters. Any suitable number of wires 274 may be packed within outer periphery 276 of its bundle 272 with any suitable density. Each wire 274 may be made of any suitable material or combination of materials for providing the second cut-resistant characteristic to cable structure 200. For example, in some embodiments, each wire 274 may be any suitable steel wire, such as stainless steel wire, a carbon steel wire (e.g., high-carbon steel, such as ASTM A228), any other suitable material, and/or any suitable combination thereof. By configuring outer cable subassembly 270 of cable structure 200 of FIG. 2 to include one or more such wires 274 (e.g., alone or in one or more outer bundles 272), outer cable subassembly 270 may provide cable structure 200 with a second cut-resistant characteristic that is particularly resistant to precision cutters, for example, as the hardness and/or thickness of such wires may require more force than realistically feasible with the opposing blades of such precision cutters. Moreover, at least one wire 274 of outer cable subassembly 270 may be configured to conduct a signal along cable 20 between first alarm subcomponent 12 and second alarm subcomponent 32, as described above.

FIG. 3 and FIG. 3A

Figure 3:
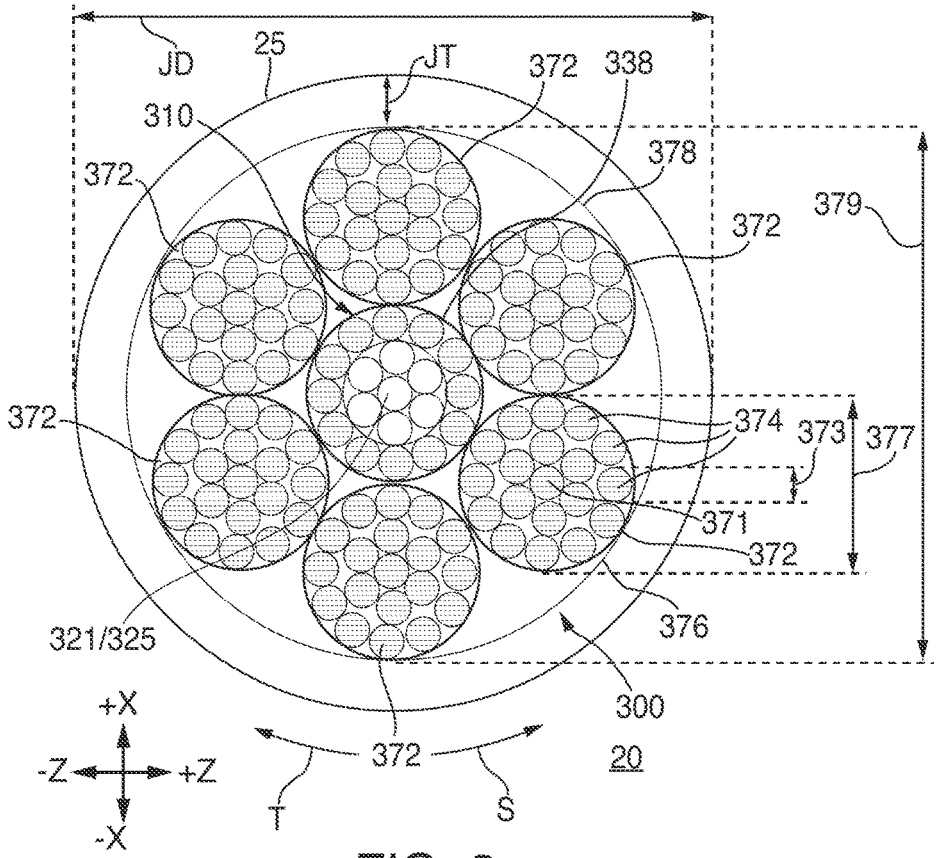
FIG. 3 is a cross-sectional view of the cable structure of FIG. 1, taken from line of FIG. 1, in accordance with some other embodiments of the invention.

In other embodiments, cable 20 may include at least one cable subassembly that includes both fibers and wires for providing that cable subassembly with both a first cut-resistant characteristic and a second cut-resistant characteristic. For example, as shown in FIG. 3, cable 20 may include a cut-resistant cable structure 300 that may be surrounded by a jacket 25 as described above with respect to FIG. 2. As shown in FIG. 3, cut-resistant cable structure 300 may include an inner cable subassembly 310 and an outer cable subassembly 370 surrounding inner cable subassembly 310 along at least a portion of the length of cable 20. Inner cable subassembly 310 may be configured to have different cut-resistant characteristics, such that inner cable subassembly 310 on its own may pose different challenges to a would-be thief. For example, inner cable subassembly 310 may be configured to have a first inner cable subassembly 320 with a first cut-resistant characteristic as well as a second inner cable subassembly 330 with a second cut-resistant characteristic that is different than the first cut-resistant characteristic. In some embodiments, the first cut-resistant characteristic may be more resistant to a shear cutter than the second cut-resistant characteristic may be to the shear cutter, for example, where such a shear cutter may include any suitable cutting tool with blades that slide against each other to cut through an object (e.g., scissors). Additionally or alternatively, the first cut-resistant characteristic may be less resistant to a precision cutter than the second cut-resistant characteristic may be to the precision cutter, for example, where such a precision cutter may include any suitable cutting tool with blades that abut each other to cut through an object (e.g., guillotine cutters, wire snips, etc.). Such a configuration may enable inner cable subassembly 310 alone (e.g., without outer cable subassembly 370) to more effectively provide a cut-resistant cable 20 that may require a would-be thief to use at least two different types of cutting tools to cut through cable 20.

Figure 3A:
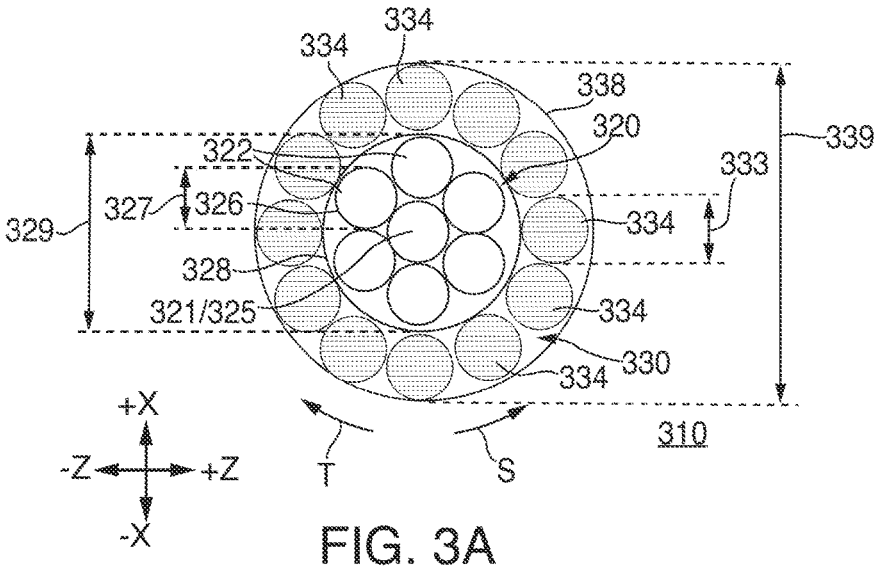
FIG. 3A is a cross-sectional view, similar to FIG. 3, of a portion of the cable structure of FIGS. 1 and 3, in accordance with some other embodiments of the invention.

First inner cable subassembly 320 of inner cable subassembly 310 may include any suitable amount of material or combinations of material organized in any suitable manner. For example, as shown in FIGS. 3 and 3A, first inner cable subassembly 320 may include one or more inner bundles 322 of material or combinations of material, where each inner bundle 322 may include a longitudinal axis 321 along which the material of that bundle 322 may extend through at least a portion of the length of cable 20 within an outer periphery 326 of that bundle 322. As shown, first inner cable subassembly 320 may include seven inner bundles 322, such that six inner bundles 322 may extend adjacent to and along the outer periphery 326 of a seventh central inner bundle 322 whose longitudinal axis 321 may be common with a central longitudinal axis 325 of first inner cable subassembly 320 and inner cable subassembly 310. While each inner bundle 322 may include material within its own outer periphery 326, the six non-central inner bundles 322 may be positioned to surround the outer periphery 326 of the seventh central inner bundle 322, and portions of the outer periphery 326 of each of the six non-central inner bundles 322 may combine to define an outer periphery 328 of first inner cable subassembly 320. It is to be understood that any suitable number of inner bundles 322 may be provided by first inner cable subassembly 320 of inner cable subassembly 310, including just one inner bundle 322 or more than seven inner bundles 322. In some embodiments, the material composition of each individual inner bundle 322 may be twisted in a particular lay direction about its own bundle longitudinal axis 321. For example, as shown in FIG. 3A, each inner bundle 322 of first inner cable subassembly 320 may be twisted in a first lay direction S (e.g., a counter-clockwise lay direction about its axis 321). Additionally or alternatively, the six non-central inner bundles 322 may be twisted in a particular lay direction about bundle longitudinal axis 321/325 of the seventh central inner bundle 322. For example, as shown in FIG. 3A, the six non-central inner bundles 322 of first inner cable subassembly 320 may be twisted in either a first lay direction S or a second lay direction T (e.g., a clockwise lay direction) about central axis 325.

First inner cable subassembly 320 of inner cable subassembly 310 may be configured to have any suitable dimensions. For example, as shown in FIG. 3A, first inner cable subassembly 320 may have an outer periphery 328 with an outer periphery cross-sectional thickness 329, which may be any suitable magnitude, such as a magnitude in a range between 0.41 millimeters and 0.55 millimeters, or, more particularly, a magnitude in a range between 0.45 millimeters and 0.51 millimeters, or, more particularly, a magnitude about or equal to 0.48 millimeters. First inner cable subassembly 320 may be disposed along any suitable portion of the length of cable 20 (e.g., any suitable portion or the entirety of the length of cable 20 from first cable end 21 to second cable end 29). If first inner cable subassembly 320 includes only a single inner bundle 322, than the outer periphery 326 of that inner bundle 322 may share the same geometry as outer periphery 328. However, if, for example, first inner cable subassembly 320 includes seven inner bundles 322, as shown in FIG. 3A, an inner bundle 322 may have an outer periphery 326 with an outer periphery cross-sectional thickness 327, which may be any suitable magnitude, such as a magnitude in a range between 0.13 millimeters and 0.19 millimeters, or, more particularly, a magnitude in a range between 0.15 millimeters and 0.17 millimeters, or, more particularly, a magnitude about or equal to 0.16 millimeters. Each inner bundle 322 may be disposed along any suitable portion of the length of cable 20 (e.g., any suitable portion or the entirety of the length of cable 20 from first cable end 21 to second cable end 29).

Each inner bundle 322 may have any suitable material composition for providing a first cut-resistant characteristic to inner cable subassembly 310 of cable structure 300. For example, each inner bundle 322 may include a bundle of individual fibers extending along longitudinal axis 321 of that bundle 322. For example, as shown in FIG. 7, an inner bundle 322 may include any suitable number of individual fibers 712 that may extend along longitudinal axis 321 of that bundle 322 within outer periphery 326 of that bundle 322. As shown, each individual fiber 712 may have a diameter or cross-sectional thickness 717, which may be any suitable magnitude, such as a magnitude in a range between 0.005 millimeters and 0.025 millimeters, or, more particularly, a magnitude in a range between 0.012 millimeters and 0.018 millimeters, or, more particularly, a magnitude about or equal to 0.015 millimeters. Any suitable number of fibers 712 may be packed within outer periphery 326 of its bundle 322 with any suitable density, such as a density in a range between 200 Deniers and 300 Deniers, or, more particularly density about or equal to 250 Deniers. Each fiber 712 may be made of any suitable material or combination of materials for providing the first cut-resistant characteristic to inner cable subassembly 310 of cable structure 300. For example, in some embodiments, each fiber 712 may be any suitable aramid fiber, such as a para-aramid synthetic fiber (e.g., Kevlar™ provided by DuPont of Wilmington, Del. or Twaron™ provided by Teijin of Osaka, Japan), or a meta-aramid (e.g., Nomex™ provided by DuPont), a copolyamide (e.g., Technora™ provided by Teijin), any suitable thermoset liquid crystalline polyoxazole (e.g., Zylon™ provided by Toyobo Corporation of Osaka, Japan), any other suitable material, and/or any suitable combination thereof. By configuring one or more inner bundles 322 of first inner cable subassembly 320 of inner cable subassembly 310 to include such a density of such fibers 712, first inner cable subassembly 320 may provide inner cable subassembly 310 with a first cut-resistant characteristic that is particularly resistant to shear cutters, for example, as the fineness and flexibility of such fibers may conform about the blades of such shear cutters without being cut.

With continued reference to FIGS. 3 and 3A, inner cable subassembly 310 may also include second inner cable subassembly 330, which may be configured to extend adjacent to and/or surround outer periphery 328 of first inner cable subassembly 320 (e.g., for providing inner cable subassembly 310 with a second cut-resistant characteristic that is different than the first cut-resistant characteristic of first inner cable subassembly 320). As shown, second inner cable subassembly 330 may include at least one wire 334 that may extend along at least a portion of the length of cable 20 and adjacent to first inner cable subassembly 320. In some embodiments, second inner cable subassembly 330 may include only a single wire 334 and, in other embodiments, second inner cable subassembly 330 may include two or more wires 374. As shown in FIGS. 3 and 3A, for example, second inner cable subassembly 330 may include twelve wires 334, each of which may extend adjacent to and along the outer periphery 328 of first inner cable subassembly 320 and central longitudinal axis 325 of first inner cable subassembly 320. While the number of wire 334 (e.g., the twelve wires) of second inner cable subassembly 330 may be positioned to surround the outer periphery 328 of first inner cable subassembly 320, portions of the outer periphery of each wire 334 may combine to define an outer periphery 338 of second inner cable subassembly 330 and, thus, the outer periphery of inner cable subassembly 310. It is to be understood that any suitable number of wires 334 or bundles of wires 334 may be provided by second inner cable subassembly 330, including just one wire 334 or more than twelve wires 334. In some embodiments, each wire 334 may be twisted in a particular lay direction about central longitudinal axis 321/325 of first inner cable subassembly 320. For example, as shown in FIGS. 3 and 3A, the twelve wires 334 of second inner cable subassembly 330 may be twisted in either a first lay direction S or a second lay direction T (e.g., a clockwise lay direction) about central axis 325.

Second inner cable subassembly 330 may be configured to have any suitable dimensions. For example, as shown in FIG. 3A, second inner cable subassembly 330 may have an outer periphery 338 with an outer periphery cross-sectional thickness 339, which may be any suitable magnitude, such as a magnitude in a range between 0.51 millimeters and 1.13 millimeters, or, more particularly, a magnitude in a range between 0.65 millimeters and 0.99 millimeters, or, more particularly, a magnitude about or equal to 0.82 millimeters. Second inner cable subassembly 330 may be disposed along any suitable portion of the length of cable 20 (e.g., any suitable portion or the entirety of the length of cable 20 from first cable end 21 to second cable end 29). As shown in FIG. 3A, each individual wire 334 of second inner cable subassembly 330 may have a diameter or cross-sectional thickness 333, which may be any suitable magnitude, such as a magnitude in a range between 0.13 millimeters and 0.21 millimeters, or, more particularly, a magnitude in a range between 0.15 millimeters and 0.19 millimeters, or, more particularly, a magnitude about or equal to 0.17 millimeters. Each wire 334 may be made of any suitable material or combination of materials for providing the second cut-resistant characteristic to inner cable subassembly 310 of cable structure 300. For example, in some embodiments, each wire 334 may be any suitable steel wire, such as stainless steel wire, a carbon steel wire (e.g., high-carbon steel, such as ASTM A228), any other suitable material, and/or any suitable combination thereof. By configuring second inner cable subassembly 330 of inner cable subassembly 310 of FIGS. 3 and 3A to include one or more such wires 334 (e.g., alone or in one or more bundles), second inner cable subassembly 330 may provide inner cable subassembly 310 with a second cut-resistant characteristic that is particularly resistant to precision cutters, for example, as the hardness and/or thickness of such wires may require more force than realistically feasible with the opposing blades of such precision cutters. Moreover, at least one wire 334 of second inner cable subassembly 330 may be configured to conduct a signal along cable 20 between first alarm subcomponent 12 and second alarm subcomponent 32, as described above.

With continued reference to FIG. 3, cable structure 300 may also include outer cable subassembly 370 that may be configured to extend adjacent to and/or surround outer periphery 338 of inner cable subassembly 310 (e.g., for providing cable structure 300 with an even more robust second cut-resistant characteristic). As shown, outer cable subassembly 370 may be substantially similar to outer cable subassembly 270 of FIG. 2, and may include at least one wire 374 that may extend along at least a portion of the length of cable 20 and adjacent to inner cable subassembly 310. In some embodiments, outer cable subassembly 370 may include only a single wire 374 and, in other embodiments, outer cable subassembly 370 may include two or more wires 374. As shown in FIG. 3, for example, outer cable subassembly 370 may include one or more outer bundles 372 of two or more wires 374, where each outer bundle 372 may include a longitudinal axis 371 along which the wires 374 of that bundle 372 may extend through at least a portion of the length of cable 20 within an outer periphery 376 of that bundle 372. As shown, outer cable subassembly 370 may include six outer bundles 372, each of which may extend adjacent to and along the outer periphery 338 of inner cable subassembly 310 and central longitudinal axis 325 of inner cable subassembly 310. While each outer bundle 372 may include two or more wires 374 within its own outer periphery 376, the six outer bundles 372 may be positioned to surround the outer periphery 338 of inner cable subassembly 310 and portions of the outer periphery 376 of each of the outer bundles 372 may combine to define an outer periphery 378 of outer cable subassembly 370. It is to be understood that any suitable number of outer bundles 372 may be provided by outer cable subassembly 370, including just one outer bundle 372 or more than six outer bundles 372. In some embodiments, the material composition (e.g., the wires 374) of each individual outer bundle 372 may be twisted in a particular lay direction about its own bundle longitudinal axis 371. For example, as shown in FIG. 3, each outer bundle 372 of outer cable subassembly 370 may be twisted in a first lay direction S (e.g., a counter-clockwise lay direction about its axis 371). Additionally or alternatively, the six outer bundles 372 may be twisted in a particular lay direction about central longitudinal axis 321/325 of inner cable subassembly 310. For example, as shown in FIG. 3, the six outer bundles 372 of outer cable subassembly 370 may be twisted in either a first lay direction S or a second lay direction T (e.g., a clockwise lay direction) about central axis 325.

Outer cable subassembly 370 may be configured to have any suitable dimensions. For example, as shown in FIG. 3, outer cable subassembly 370 may have an outer periphery 378 with an outer periphery cross-sectional thickness 379, which may be any suitable magnitude, such as a magnitude in a range between 2.1 millimeters and 2.9 millimeters, or, more particularly, a magnitude in a range between 2.3 millimeters and 2.7 millimeters, or, more particularly, a magnitude about or equal to 2.5 millimeters. Outer cable subassembly 370 may be disposed along any suitable portion of the length of cable 20 (e.g., any suitable portion or the entirety of the length of cable 20 from first cable end 21 to second cable end 29). If outer cable subassembly 370 includes only a single wire 374, than the cross-sectional thickness (e.g., thickness 373) of that wire 374 may share the same geometry as outer periphery 378. However, if, for example, outer cable subassembly 370 includes one or more bundles 372 of two or more wires 374, as shown in FIG. 3, an outer bundle 372 may have an outer periphery 376 with an outer periphery cross-sectional thickness 377, which may be any suitable magnitude, such as a magnitude in a range between 0.51 millimeters and 1.19 millimeters, or, more particularly, a magnitude in a range between 0.68 millimeters and 1.02 millimeters, or, more particularly, a magnitude about or equal to 0.85 millimeters. Each outer bundle 372 may be disposed along any suitable portion of the length of cable 20 (e.g., any suitable portion or the entirety of the length of cable 20 from first cable end 21 to second cable end 29).

Each outer bundle 372 may have any suitable material composition for providing a second cut-resistant characteristic to cable structure 300. For example, each outer bundle 372 may include a bundle of individual wires 374 extending along longitudinal axis 371 of that bundle 372. For example, as shown in FIG. 3, an outer bundle 372 may include any suitable number of individual wires 374 (e.g., nineteen wires 374) that may extend along longitudinal axis 371 of that bundle 372 within outer periphery 376 of that bundle 372. As shown, each individual wire 374 may have a diameter or cross-sectional thickness 373, which may be any suitable magnitude, such as a magnitude in a range between 0.13 millimeters and 0.21 millimeters, or, more particularly, a magnitude in a range between 0.15 millimeters and 0.19 millimeters, or, more particularly, a magnitude about or equal to 0.17 millimeters. Any suitable number of wires 374 may be packed within outer periphery 376 of its bundle 372 with any suitable density. Each wire 374 may be made of any suitable material or combination of materials for providing the second cut-resistant characteristic to cable structure 300. For example, in some embodiments, each wire 374 may be any suitable steel wire, such as stainless steel wire, a carbon steel wire (e.g., high-carbon steel, such as ASTM A228), any other suitable material, and/or any suitable combination thereof. By configuring outer cable subassembly 370 of cable structure 300 of FIG. 3 to include one or more such wires 374 (e.g., alone or in one or more outer bundles 372), outer cable subassembly 370 may provide cable structure 300 with a second cut-resistant characteristic that is particularly resistant to precision cutters, for example, as the hardness and/or thickness of such wires may require more force than realistically feasible with the opposing blades of such precision cutters. Moreover, at least one wire 374 of outer cable subassembly 370 may be configured to conduct a signal along cable 20 between first alarm subcomponent 12 and second alarm subcomponent 32, as described above.

FIG. 4

Figure 4:
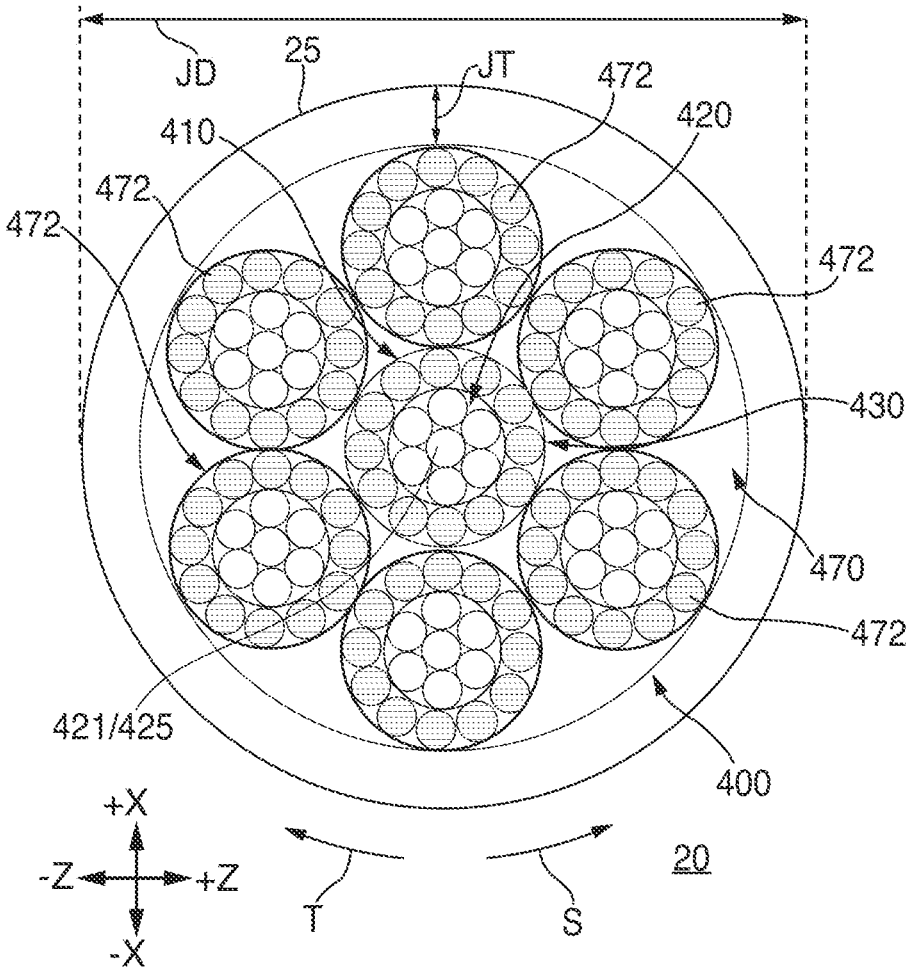
FIG. 4 is a cross-sectional view of the cable structure of FIG. 1, taken from line IV-IV of FIG. 1, in accordance with some other embodiments of the invention.

In other embodiments, cable 20 may include at least two cable subassemblies, each of which may include both fibers and wires for providing that cable subassembly with both a first cut-resistant characteristic and a second cut-resistant characteristic. For example, as shown in FIG. 4, cable 20 may include a cut-resistant cable structure 400 that may be surrounded by a jacket 25 as described above with respect to FIG. 2. As shown in FIG. 4, cut-resistant cable structure 400 may include an inner cable subassembly 410 and an outer cable subassembly 470 surrounding inner cable subassembly 410 along at least a portion of the length of cable 20. Inner cable subassembly 410 may be configured to have different cut-resistant characteristics, such that inner cable subassembly 410 on its own may pose different challenges to a would-be thief. For example, inner cable subassembly 410 may be similar to inner cable subassembly 310 and may be configured to have a first inner cable subassembly 420 that may be the same as first inner cable subassembly 320 with a first cut-resistant characteristic and a central longitudinal axis 421/425, as well as a second inner cable subassembly 430 that may be the same as second inner cable subassembly 330 with a second cut-resistant characteristic that is different than the first cut-resistant characteristic. At least one wire of second inner cable subassembly 430 may be configured to conduct a signal along cable 20 between first alarm subcomponent 12 and second alarm subcomponent 32, as described above.

Moreover, outer cable subassembly 470 of cable structure 400 may be configured to extend adjacent to and/or surround an outer periphery of inner cable subassembly 410 (e.g., for providing cable structure 400 with an even more robust first cut-resistant characteristic and second cut-resistant characteristic). As shown, outer cable subassembly 470 may include one or more outer bundles 472, each of which may be substantially similar to inner cable subassembly 410 and/or inner cable subassembly 310. For example, as shown in FIG. 4, each outer bundle 472 may include both fibers and wires in a similar configuration to each one of inner cable subassembly 410 and/or inner cable subassembly 310. As shown in FIG. 4, for example, outer cable subassembly 370 may include six outer bundles 472, each of which may extend adjacent to and along the outer periphery of inner cable subassembly 410 and central longitudinal axis 425 of inner cable subassembly 410. Such outer bundles 472 may be positioned to surround the outer periphery of inner cable subassembly 410 and portions of the outer periphery of each of the outer bundles 472 may combine to define an outer periphery of outer cable subassembly 470 and, thus, the outer periphery of cable structure 400. It is to be understood that any suitable number of outer bundles 472 may be provided by outer cable subassembly 470, including just one outer bundle 472 or more than six outer bundles 472. In some embodiments, the material composition (e.g., the wires and/or fibers) of each individual outer bundle 472 may be twisted in a particular lay direction about its own bundle longitudinal axis. For example, as shown in FIG. 4, each outer bundle 472 of outer cable subassembly 470 may be twisted in a first lay direction S (e.g., a counter-clockwise lay direction) about the longitudinal axis of that bundle 472. Additionally or alternatively, the six outer bundles 472 may be twisted in a particular lay direction about central longitudinal axis 425 of inner cable subassembly 410. For example, as shown in FIG. 4, the six outer bundles 472 of outer cable subassembly 470 may be twisted in either a first lay direction S or a second lay direction T (e.g., a clockwise lay direction) about central axis 425. Moreover, at least one wire of at least one outer bundle 472 of outer cable subassembly 470 may be configured to conduct a signal along cable 20 between first alarm subcomponent 12 and second alarm subcomponent 32, as described above.

FIG. 5 and FIG. 5A

Figure 5:
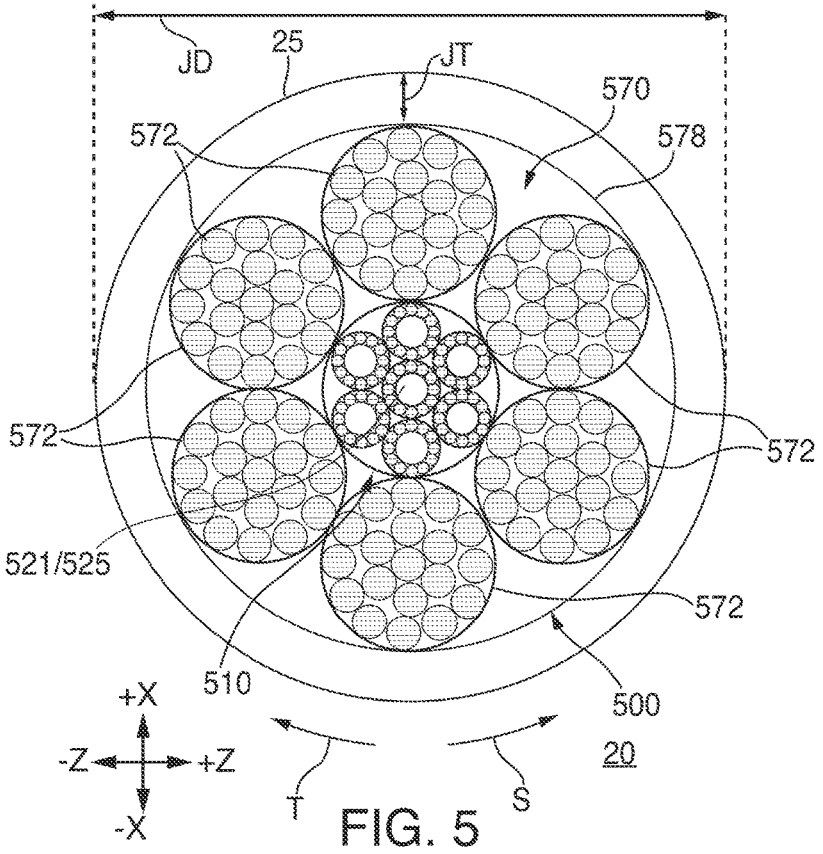
FIG. 5 is a cross-sectional view of the cable structure of FIG. 1, taken from line V-V of FIG. 1, in accordance with some other embodiments of the invention.
Figure 5A:
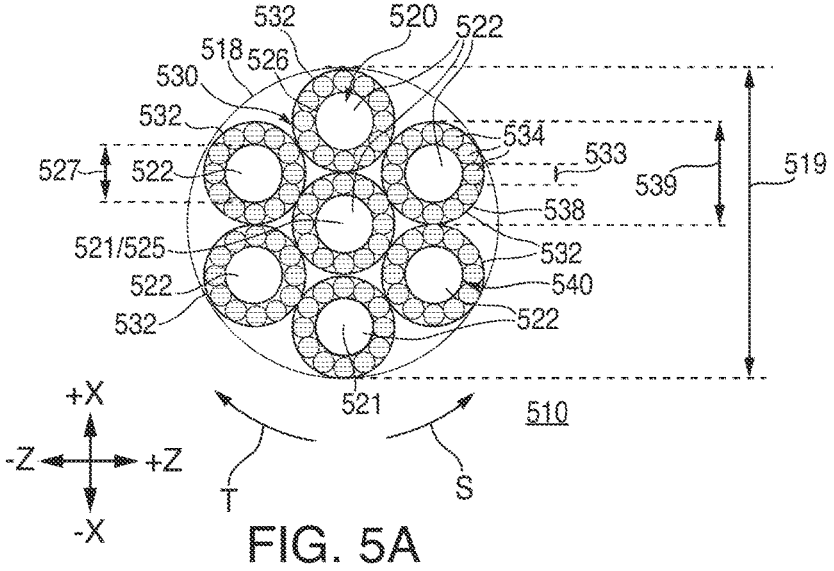
FIG. 5A is a cross-sectional view, similar to FIG. 5, of a portion of the cable structure of FIGS. 1 and 5, in accordance with some other embodiments of the invention.

In other embodiments, cable 20 may include at least one cable subassembly with bundle combinations that may include both fibers and wires for providing that cable subassembly with both a first cut-resistant characteristic and a second cut-resistant characteristic. For example, as shown in FIGS. 5 and 5A, cable 20 may include a cut-resistant cable structure 500 that may be surrounded by a jacket 25 as described above with respect to FIG. 2. As shown in FIG. 5, cut-resistant cable structure 500 may include an inner cable subassembly 510 and an outer cable subassembly 570 surrounding inner cable subassembly 510 along at least a portion of the length of cable 20. Inner cable subassembly 510 may be configured to have different cut-resistant characteristics within a single bundle, such that such a bundle of inner cable subassembly 510 on its own may pose different challenges to a would-be thief. For example, inner cable subassembly 510 may be configured to have at least one first inner cable subassembly 520 with a first cut-resistant characteristic as well as at least one associated second inner cable subassembly 530 with a second cut-resistant characteristic that is different than the first cut-resistant characteristic, where the associated pair of a particular first inner cable subassembly 520 and a particular second inner cable subassembly 530 may combine to form a particular bundle or bundle combination 540 with both types of cut-resistance characteristics. As shown in FIG. 5A, for example, each bundle combination 540 may include a particular second inner cable subassembly 530 adjacent to and/or surrounding a particular first inner cable subassembly 520 along at least a portion of the length of cable 20. In some embodiments, the first cut-resistant characteristic of a particular first inner cable subassembly 520 of a particular bundle combination 540 may be more resistant to a shear cutter than the second cut-resistant characteristic of the particular second inner cable subassembly 530 of that particular bundle combination 540 may be to the shear cutter, for example, where such a shear cutter may include any suitable cutting tool with blades that slide against each other to cut through an object (e.g., scissors). Additionally or alternatively, the first cut-resistant characteristic may be less resistant to a precision cutter than the second cut-resistant characteristic may be to the precision cutter, for example, where such a precision cutter may include any suitable cutting tool with blades that abut each other to cut through an object (e.g., guillotine cutters, wire snips, etc.). Such a configuration may enable a single bundle combination 540 of inner cable subassembly 510 alone (e.g., without outer cable subassembly 570) to more effectively provide a cut-resistant cable 20 that may require a would-be thief to use at least two different types of cutting tools to cut through cable 20.

As shown in FIGS. 5 and 5A, inner cable subassembly 510 may include seven bundle combinations 540 of particular pairs of a particular first inner cable subassembly 520 and a particular second inner cable subassembly 530, such that six inner bundle combinations 540 may extend adjacent to and along the outer periphery of a seventh central bundle combinations 540 whose longitudinal axis 521 may be common with a central longitudinal axis 525 of inner cable subassembly 510. While the six non-central bundle combinations 540 may be positioned to surround the outer periphery of the seventh central bundle combinations 540, portions of the outer periphery 538 of each of the six non-central bundle combinations 540 may combine to define an outer periphery 518 of inner cable subassembly 510. It is to be understood that any suitable number of such bundle combinations 540 (e.g., a single bundle combination or any other number greater or less than seven bundle combinations) may be provided by inner cable subassembly 510. In some embodiments, the material composition of each bundle combination 540 may be twisted in a particular lay direction about its own bundle combination longitudinal axis 521 (e.g., the longitudinal axis of the first inner cable subassembly 510 of that bundle combination 540). For example, as shown in FIG. 5A, each bundle combination 540 may be twisted in a first lay direction S (e.g., a counter-clockwise lay direction) about its axis 521. Additionally or alternatively, the six non-central bundle combinations 540 may be twisted in a particular lay direction about bundle longitudinal axis 521/525 of the seventh central bundle combination 540. For example, as shown in FIG. 5A, the six non-central bundle combinations 540 of inner cable subassembly 510 may be twisted in either a first lay direction S or a second lay direction T (e.g., a clockwise lay direction) about central axis 525.

A first inner cable subassembly 520 of a particular bundle combination 540 of inner cable subassembly 510 may include any suitable amount of material or combinations of material organized in any suitable manner. For example, as shown in FIGS. 5 and 5A, first inner cable subassembly 520 may include one or more inner bundles 522 of material or combinations of material, where each inner bundle 522 may include a longitudinal axis 521 along which the material of that bundle 522 may extend through at least a portion of the length of cable 20 within an outer periphery 526 of that bundle 522. As shown, a particular first inner cable subassembly 520 may just a single bundle 522, although suitable number of two or more bundles 522 within a single first inner cable subassembly 520 may be possible in other embodiments. A first inner cable subassembly 520 of inner cable subassembly 510 may be configured to have any suitable dimensions. For example, as shown in FIG. 5A, first inner cable subassembly 520 may have an outer periphery 526 with an outer periphery cross-sectional thickness 527, which may be any suitable magnitude, such as a magnitude in a range between 0.11 millimeters and 0.23 millimeters, or, more particularly, a magnitude in a range between 0.15 millimeters and 0.19 millimeters, or, more particularly, a magnitude about or equal to 0.17 millimeters. First inner cable subassembly 520 may be disposed along any suitable portion of the length of cable 20 (e.g., any suitable portion or the entirety of the length of cable 20 from first cable end 21 to second cable end 29). If first inner cable subassembly 520 includes only a single inner bundle 522, than the outer periphery of that inner bundle 522 may share the same geometry as outer periphery 526.

Each inner bundle 522 may have any suitable material composition for providing a first cut-resistant characteristic to inner cable subassembly 510 of cable structure 500. For example, each inner bundle 522 may include a bundle of individual fibers extending along longitudinal axis 521 of that bundle 522. For example, as shown in FIG. 7, an inner bundle 522 may include any suitable number of individual fibers 712 that may extend along longitudinal axis 521 of that bundle 522 within outer periphery 526 of that bundle 522. As shown, each individual fiber 712 may have a diameter or cross-sectional thickness 717, which may be any suitable magnitude, such as a magnitude in a range between 0.005 millimeters and 0.025 millimeters, or, more particularly, a magnitude in a range between 0.012 millimeters and 0.018 millimeters, or, more particularly, a magnitude about or equal to 0.015 millimeters. Any suitable number of fibers 712 may be packed within outer periphery 526 of its bundle 522 with any suitable density, such as a density in a range between 250 Deniers and 350 Deniers, or, more particularly density about or equal to 300 Deniers. Each fiber 712 may be made of any suitable material or combination of materials for providing the first cut-resistant characteristic to inner cable subassembly 510 of cable structure 500. For example, in some embodiments, each fiber 712 may be any suitable aramid fiber, such as a para-aramid synthetic fiber (e.g., Kevlar™ provided by DuPont of Wilmington, Del. or Twaron™ provided by Teijin of Osaka, Japan), or a meta-aramid (e.g., Nomex™ provided by DuPont), a copolyamide (e.g., Technora™ provided by Teijin), any suitable thermoset liquid crystalline polyoxazole Zylon™ provided by Toyobo Corporation of Osaka, Japan), any other suitable material, and/or any suitable combination thereof. By configuring one or more inner bundles 522 of first inner cable subassembly 520 of inner cable subassembly 510 to include such a density of such fibers 712, first inner cable subassembly 520 may provide inner cable subassembly 510 with a first cut-resistant characteristic that is particularly resistant to shear cutters, for example, as the fineness and flexibility of such fibers may conform about the blades of such shear cutters without being cut.

With continued reference to FIGS. 5 and 5A, a second inner cable subassembly 530 of a particular bundle combination 540 of inner cable subassembly 510 may be configured to extend adjacent to and/or surround outer periphery 526 of the first inner cable subassembly 520 of that particular bundle combination 540 (e.g., for providing that particular bundle combination 540 with a second cut-resistant characteristic that is different than the first cut-resistant characteristic of first inner cable subassembly 520). As shown, a second inner cable subassembly 530 may include at least one wire 534 that may extend along at least a portion of the length of cable 20 and adjacent to a first inner cable subassembly 520 of a particular bundle combination 540. In some embodiments, second inner cable subassembly 530 may include only a single wire 534 and, in other embodiments, second inner cable subassembly 530 may include two or more wires 534. As shown in FIGS. 5 and 5A, for example, second inner cable subassembly 530 may include thirteen wires 534, each of which may extend adjacent to and along the outer periphery 526 of the first inner cable subassembly 520 of a particular bundle combination 540 and the central longitudinal axis 521 of that first inner cable subassembly 520. While the number of wires 534 (e.g., the thirteen wires) of second inner cable subassembly 530 may be positioned to surround the outer periphery 526 of first inner cable subassembly 520, portions of the outer periphery of each wire 534 may combine to define an outer periphery 538 of second inner cable subassembly 530 and, thus, the outer periphery of the particular bundle combination 540. Moreover, as shown in FIG. 5A, portions of the outer periphery of certain wires 534 of certain bundle combinations 540, may combine to define an outer periphery 518 of inner cable subassembly 510. It is to be understood that any suitable number of wires 534 or bundles of wires 534 may be provided by second inner cable subassembly 530, including just one wire 534 or more than thirteen wires 534. In some embodiments, each wire 534 may be twisted in a particular lay direction about central longitudinal axis 521 of first inner cable subassembly 520 of its particular bundle combination 540. For example, as shown in FIGS. 5 and 5A, the thirteen wires 534 of a second inner cable subassembly 530 may be twisted in either a first lay direction S or a second lay direction T (e.g., a clockwise lay direction) about central axis 521.

Each second inner cable subassembly 530 may be configured to have any suitable dimensions. For example, as shown in FIG. 5A, a second inner cable subassembly 530 may have an outer periphery 538 with an outer periphery cross-sectional thickness 539, which may be any suitable magnitude, such as a magnitude in a range between 0.23 millimeters and 0.31 millimeters, or, more particularly, a magnitude in a range between 0.25 millimeters and 0.29 millimeters, or, more particularly, a magnitude about or equal to 0.27 millimeters. Second inner cable subassembly 530 may be disposed along any suitable portion of the length of cable 20 (e.g., any suitable portion or the entirety of the length of cable 20 from first cable end 21 to second cable end 29). As shown in FIG. 5A, each individual wire 534 of second inner cable subassembly 530 may have a diameter or cross-sectional thickness 533, which may be any suitable magnitude, such as a magnitude in a range between 0.03 millimeters and 0.07 millimeters, or, more particularly, a magnitude in a range between 0.04 millimeters and 0.06 millimeters, or, more particularly, a magnitude about or equal to 0.05 millimeters. Each wire 534 may be made of any suitable material or combination of materials for providing a second cut-resistant characteristic to a particular bundle combination 540 of inner cable subassembly 510 of cable structure 500. For example, in some embodiments, each wire 534 may be any suitable metal wire, such as copper or copper with an enamel coating to prevent rust. By configuring a particular bundle combination 540 of inner cable subassembly 510 of FIGS. 5 and 5A to include one or more such wires 534, second inner cable subassembly 530 may provide the bundle combination 540 with an additional cut-resistant characteristic that may be different to that of first inner cable subassembly 520 of that particular bundle combination 540. Moreover, at least one wire 534 of second inner cable subassembly 530 may be configured to conduct a signal along cable 20 between first alarm subcomponent 12 and second alarm subcomponent 32, as described above.

With continued reference to FIG. 5, cable structure 500 may also include outer cable subassembly 570 that may be configured to extend adjacent to and/or surround outer periphery 518 of inner cable subassembly 510 (e.g., for providing cable structure 500 with an even more robust second cut-resistant characteristic). As shown, outer cable subassembly 570 may be substantially similar to outer cable subassembly 270 of FIG. 2 and/or outer cable subassembly 370 of FIG. 3, and may include at least one wire bundle 572 that may be substantially similar to bundle 272 of FIG. 2 and/or bundle 372 of FIG. 3 that may extend along at least a portion of the length of cable 20 and adjacent to inner cable subassembly 510. As shown, outer cable subassembly 570 may include six outer bundles 572, each of which may extend adjacent to and along the outer periphery 518 of inner cable subassembly 510 and central longitudinal axis 525 of inner cable subassembly 510. While each outer bundle 572 may include two or more wires within its own outer periphery, the six outer bundles 572 may be positioned to surround the outer periphery 518 of inner cable subassembly 510, and portions of the outer periphery of each of the outer bundles 572 may combine to define an outer periphery 578 of outer cable subassembly 570. It is to be understood that any suitable number of outer bundles 572 may be provided by outer cable subassembly 570, including just one outer bundle 572 or more than six outer bundles 572. In some embodiments, the material composition (e.g., the wires) of each individual outer bundle 572 may be twisted in a particular lay direction about its own bundle longitudinal axis. For example, as shown in FIG. 5, each outer bundle 572 of outer cable subassembly 570 may be twisted in a first lay direction S (e.g., a counter-clockwise lay direction) about its bundle axis. Additionally or alternatively, the six outer bundles 572 may be twisted in a particular lay direction about central longitudinal axis 521/525 of inner cable subassembly 510. For example, as shown in FIG. 5, the six outer bundles 572 of outer cable subassembly 570 may be twisted in either a first lay direction S or a second lay direction T (e.g., a clockwise lay direction) about central axis 525.

FIG. 6

Figure 6:
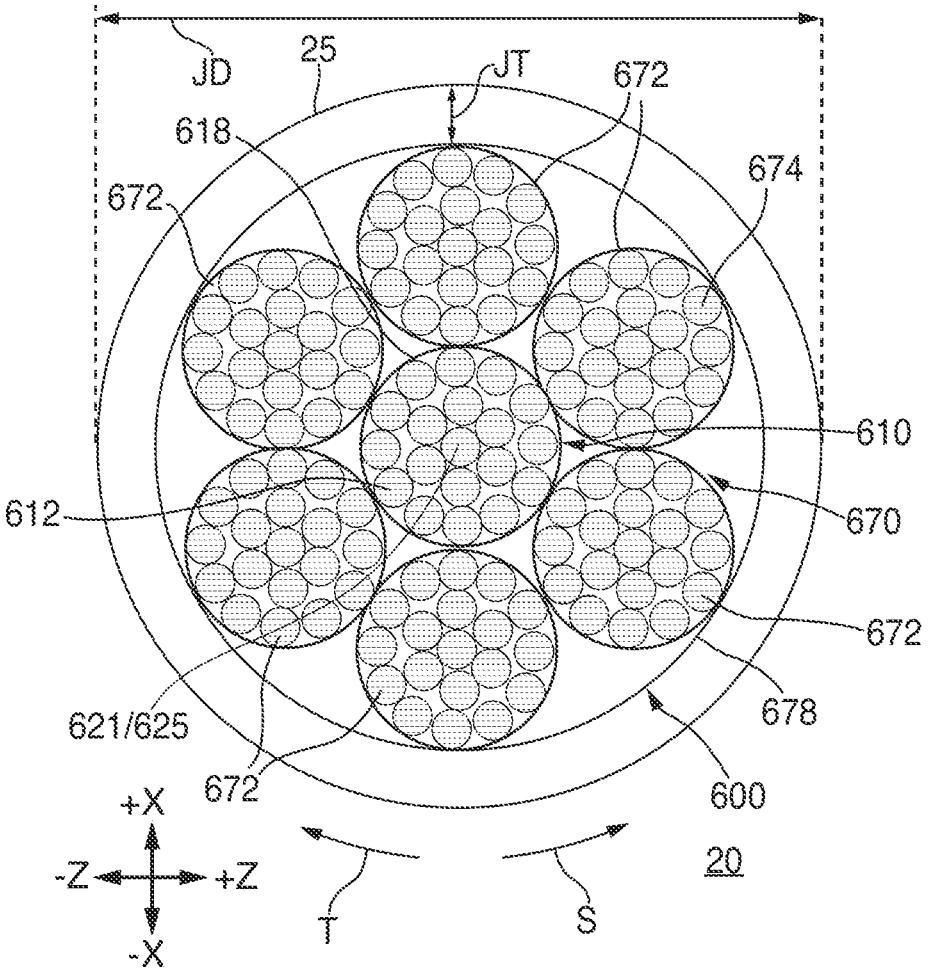
FIG. 6 is a cross-sectional view of the cable structure of FIG. 1, taken from line VI-VI of FIG. 1, in accordance with some other embodiments of the invention.

In other embodiments, cable 20 may include multiple instances of a cable subassembly that includes multiple wires. For example, as shown in FIG. 6, cable 20 may include a cut-resistant cable structure 600 that may be surrounded by a jacket 25 as described above with respect to FIG. 2. As shown in FIG. 6, cut-resistant cable structure 600 may include an inner cable subassembly 610 and an outer cable subassembly 670 surrounding inner cable subassembly 610 along at least a portion of the length of cable 20. Inner cable subassembly 610 may include at least one wire bundle 612 that may be substantially similar to a wire bundle 272 of outer cable subassembly 270 of FIG. 2 and/or a wire bundle 372 of outer cable subassembly 370 of FIG. 3 that may extend along at least a portion of the length of cable 20 along a central longitudinal axis 621/625 of inner cable subassembly 610. In some embodiments, the material composition (e.g., the wires) of bundle 612 may be twisted in a particular lay direction about its own bundle longitudinal axis. For example, as shown in FIG. 6, bundle 612 of inner cable subassembly 610 may be twisted in a first lay direction S (e.g., a counter-clockwise lay direction) about its bundle axis 621/625. With continued reference to FIG. 6, cable structure 600 may also include outer cable subassembly 670 that may be configured to extend adjacent to and/or surround the outer periphery of inner cable subassembly 610 (e.g., for providing cable structure 600 with an even more robust second cut-resistant characteristic). As shown, outer cable subassembly 670 may be substantially similar to outer cable subassembly 270 of FIG. 2 and/or outer cable subassembly 370 of FIG. 3, and may include at least one wire bundle 672 that may be substantially similar to bundle 272 of FIG. 2 and/or bundle 372 of FIG. 3 that may extend along at least a portion of the length of cable 20 and adjacent to inner cable subassembly 610. As shown, outer cable subassembly 670 may include six outer bundles 672, each of which may extend adjacent to and along the outer periphery 618 of inner cable subassembly 610 and central longitudinal axis 625 of inner cable subassembly 610. While each outer bundle 672 may include two or more wires within its own outer periphery, the six outer bundles 672 may be positioned to surround the outer periphery 618 of inner cable subassembly 610, and portions of the outer periphery of each of the outer bundles 672 may combine to define an outer periphery 678 of outer cable subassembly 670. It is to be understood that any suitable number of outer bundles 672 may be provided by outer cable subassembly 670, including just one outer bundle 672 or more than six outer bundles 672. In some embodiments, the material composition (e.g., the wires) of each individual outer bundle 672 may be twisted in a particular lay direction about its own bundle longitudinal axis. For example, as shown in FIG. 6, each outer bundle 672 of outer cable subassembly 670 may be twisted in a first lay direction S (e.g., a counter-clockwise lay direction) about its bundle axis. Additionally or alternatively, the six outer bundles 672 may be twisted in a particular lay direction about central longitudinal axis 621/625 of inner cable subassembly 610. For example, as shown in FIG. 6, the six outer bundles 672 of outer cable subassembly 670 may be twisted in either a first lay direction S or a second lay direction T (e.g., a clockwise lay direction) about central axis 625.

FIG. 8

Figure 8:
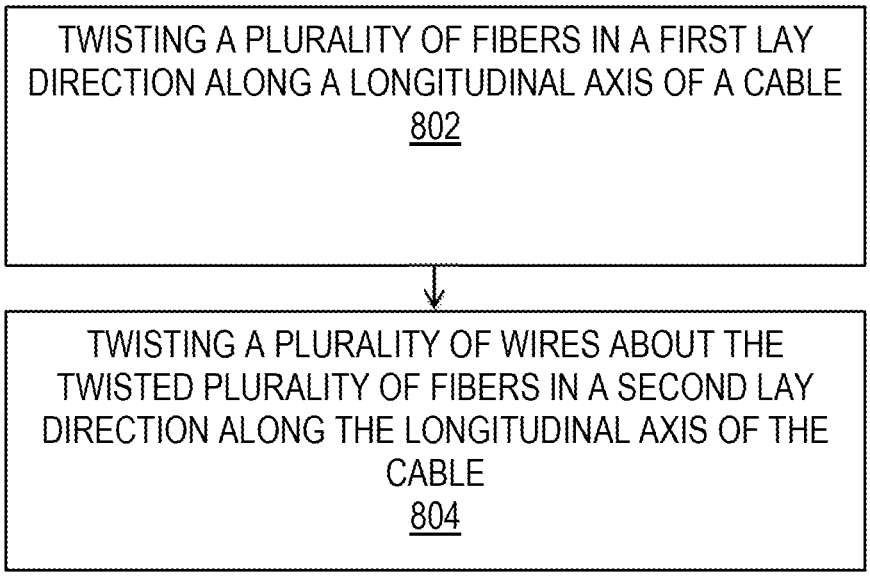
FIG. 8 is a flowchart of an illustrative process for manufacturing a cable structure, in accordance with various embodiments of the invention.

FIG. 8 is a flowchart of an illustrative process 800 for forming a cable. At step 802 of process 800, a group of fibers may be twisted in a first lay direction along a longitudinal axis of the cable. For example, as described at least with respect to FIG. 2, at least one bundle 212 of fibers of inner cable subassembly 210 may be twisted in lay direction S or lay direction T along longitudinal axis 211/215 of cable structure 200. At step 804 of process 800, a group of wires may be twisted about the twisted group of fibers in a second lay direction along a longitudinal axis of the cable. For example, as described at least with respect to FIG. 2, at least one bundle 272 of wires may be twisted about inner cable subassembly 210 in lay direction S or lay direction T along longitudinal axis 211/215 of cable structure 200.

It is understood that the steps shown in process 800 of FIG. 8 are merely illustrative and that existing steps may be modified or omitted, additional steps may be added, and the order of certain steps may be altered.

While there have been described cut-resistant cable structures and systems and methods for making the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up" and "down," "front" and "back," "top" and "bottom" and "side," "length" and "width" and "thickness" and "diameter" and "cross-section" and "longitudinal," "X-" and "Y-" and "Z-," and the like that may be used herein only for convenience, and that no fixed or absolute directional or orientational limitations are intended by the use of these words. For example, the cable structures of this invention can have any desired orientation. If reoriented, different directional or orientational terms may need to be used in their description, but that will not alter their fundamental nature as within the scope and spirit of this invention.

Therefore, those skilled in the art will appreciate that the invention can be practiced by other than the described embodiments, which are presented for purposes of illustration rather than of limitation.

What is claimed is:

1. A cable assembly comprising:

a cable structure comprising:

a first cable subassembly extending along at least a portion of a length of the cable structure; and a second cable subassembly extending along at least the portion of the length of the cable structure; and a jacket extending around an outer periphery of the cable structure along at least the portion of the length of the cable structure, wherein:

the first cable subassembly comprises a first cut-resistant characteristic; and the second cable subassembly comprises a second cut-resistant characteristic that is different than the first cut-resistant characteristic.

2. The cable assembly of claim 1, wherein:

the first cut-resistant characteristic is more resistant to a shear cutter than the second cut-resistant characteristic is to the shear cutter; and the shear cutter comprises blades that slide against each other to cut through an object.

3. The cable assembly of claim 2, wherein:

the first cut-resistant characteristic is less resistant to a precision cutter than the second cut-resistant characteristic is to the precision cutter; and the precision cutter comprises blades that abut each other to cut through an object.

4. The cable assembly of claim 1, wherein:

the first cut-resistant characteristic is less resistant to a precision cutter than the second cut-resistant characteristic is to the precision cutter; and the precision cutter comprises blades that abut each other to cut through an object.

5. The cable assembly of claim 1, wherein:

the first cable subassembly comprises a plurality of fibers extending along the portion of the length of the cable structure;

at least one fiber of the plurality of fibers comprises a first cross-sectional thickness;

the second cable subassembly comprises at least one wire extending along the portion of the length of the cable structure; and at least one wire of the at least one wire comprises a second cross-sectional thickness that is greater than the first cross-sectional thickness.

6. The cable assembly of claim 5,
wherein the plurality of fibers comprises a third cross-sectional thickness; and
the third cross-sectional thickness is between 0.13 millimeters and 0.33 millimeters.

7. The cable assembly of claim 5, wherein:
each fiber of the plurality of fibers comprises an aramid fiber; and
each wire of the at least one wire comprises a steel wire.

8. The cable assembly of claim 5, wherein:
the first cable subassembly comprises a plurality of fiber bundles;
the plurality of fiber bundles defines a cross-sectional outer periphery of the first cable subassembly;
each fiber bundle of the plurality of fiber bundles comprises a sub-plurality of fibers of the plurality of fibers;
the at least one wire comprises a plurality of wires;
each wire of the plurality of wires extends along the portion of the length of the cable structure and adjacent to the cross-sectional outer periphery of the first cable subassembly; and
the plurality of wires surrounds the cross-sectional outer periphery of the first cable subassembly.

9. The cable assembly of claim 8, wherein:
at least one sub-plurality of fibers of at least one fiber bundle of the plurality of fiber bundles is twisted in a first lay direction along a longitudinal axis of that fiber bundle; and
at least one wire of the plurality of wires is twisted in a second lay direction along a longitudinal axis of the first cable subassembly.

10. The cable assembly of claim 8, wherein:
the plurality of wires of the second cable subassembly defines a cross-sectional outer periphery of the second cable subassembly;
the cable structure further comprises a third cable subassembly extending along at least the portion of the length of the cable structure;
the third cable subassembly comprises a plurality of wire bundles;
each wire bundle of the plurality of wire bundles comprises a plurality of bundled wires;
each wire bundle of the plurality of wire bundles extends along the portion of the length of the cable structure and adjacent to the cross-sectional outer periphery of the second cable subassembly; and
the plurality of wire bundles surrounds the cross-sectional outer periphery of the second cable subassembly.

11. The cable assembly of claim 10, wherein:
at least one sub-plurality of fibers of at least one fiber bundle of the plurality of fiber bundles is twisted in a first lay direction along a longitudinal axis of that fiber bundle;
at least one wire of the plurality of wires of the second cable subassembly is twisted in a second lay direction along a longitudinal axis of the first cable subassembly; and
at least one plurality of bundled wires of at least one wire bundle of the plurality of wire bundles is twisted in a third lay direction along a longitudinal axis of that wire bundle.

12. The cable assembly of claim 10, wherein:
each sub-plurality of fibers of each fiber bundle of the plurality of fiber bundles is twisted in a first lay direction along a longitudinal axis of that fiber bundle;
each wire of the plurality of wires of the second cable subassembly is twisted in a second lay direction along a longitudinal axis of the first cable subassembly; and
each plurality of bundled wires of each wire bundle of the plurality of wire bundles is twisted in a third lay direction along a longitudinal axis of that wire bundle.

13. The cable assembly of claim 8, wherein:
each sub-plurality of fibers of each fiber bundle of the plurality of fiber bundles is twisted in a first lay direction along a longitudinal axis of that fiber bundle; and
each wire of the plurality of wires is twisted in a second lay direction along a longitudinal axis of the first cable subassembly.

14. The cable assembly of claim 5, wherein:
the at least one wire of the second cable subassembly comprises a plurality of wires;
the plurality of wires of the second cable subassembly comprises a plurality of sub-plurality of wires;
the first cable subassembly comprises a plurality of fiber bundles;
at least one fiber bundle of the plurality of fiber bundles comprises a sub-plurality of fibers of the plurality of fibers;
at least one sub-plurality of wires of the plurality of wires of the second cable subassembly surrounds a cross-sectional outer periphery of a respective fiber bundle of the plurality of fiber bundles of the first cable subassembly; and
at least one wire of a particular sub-plurality of wires extends along the portion of the length of the cable structure and adjacent to the cross-sectional outer periphery of its respective fiber bundle.

15. The cable assembly of claim 14, wherein:
the cable structure further comprises a third cable subassembly extending along at least the portion of the length of the cable structure;
the third cable subassembly comprises a plurality of wire bundles;
at least one wire bundle of the plurality of wire bundles comprises a plurality of bundled wires;
the at least one wire bundle of the plurality of wire bundles extends along the portion of the length of the cable structure and adjacent to a cross-sectional outer periphery of the second cable subassembly; and
the plurality of wire bundles surrounds the cross-sectional outer periphery of the second cable subassembly.

16. The cable assembly of claim 14, wherein:
the cable structure further comprises a third cable subassembly extending along at least the portion of the length of the cable structure;
the third cable subassembly comprises a plurality of wire bundles;
each wire bundle of the plurality of wire bundles comprises a plurality of bundled wires;
each wire bundle of the plurality of wire bundles extends along the portion of the length of the cable structure and adjacent to a cross-sectional outer periphery of the second cable subassembly; and
the plurality of wire bundles surrounds the cross-sectional outer periphery of the second cable subassembly.

17. The cable assembly of claim 5, wherein:
the first cable subassembly comprises a plurality of fiber bundles;
at least one fiber bundle of the plurality of fiber bundles comprises a sub-plurality of fibers of the plurality of fibers;

the at least one wire comprises a plurality of wires;

the plurality of wires comprises a plurality of wire bundles;

at least one wire bundle of the plurality of wire bundles comprises a sub-plurality of wires of the plurality of wires;

the at least one wire bundle of the plurality of wire bundles extends along the portion of the length of the cable structure and adjacent to a cross-sectional outer periphery of the first cable subassembly; and the plurality of wire bundles surrounds the cross-sectional outer periphery of the first cable subassembly.

18. The cable assembly of claim 5, wherein:

the at least one wire of the second cable subassembly comprises a plurality of wires;

the plurality of wires of the second cable subassembly comprises a plurality of sub-plurality of wires;

the first cable subassembly comprises a plurality of fiber bundles;

each fiber bundle of the plurality of fiber bundles comprises a sub-plurality of fibers of the plurality of fibers;

each sub-plurality of wires of the plurality of wires of the second cable subassembly surrounds a cross-sectional outer periphery of a respective fiber bundle of the plurality of fiber bundles of the first cable subassembly; and each wire of a particular sub-plurality of wires extends along the portion of the length of the cable structure and adjacent to the cross-sectional outer periphery of its respective fiber bundle.

19. The cable assembly of claim 5, wherein:

the first cable subassembly comprises a plurality of fiber bundles;

each fiber bundle of the plurality of fiber bundles comprises a sub-plurality of fibers of the plurality of fibers;

the at least one wire comprises a plurality of wires;

the plurality of wires comprises a plurality of wire bundles;

each wire bundle of the plurality of wire bundles comprises a sub-plurality of wires of the plurality of wires;

each wire bundle of the plurality of wire bundles extends along the portion of the length of the cable structure and adjacent to a cross-sectional outer periphery of the first cable subassembly; and the plurality of wire bundles surrounds the cross-sectional outer periphery of the first cable subassembly.

20. The cable assembly of claim 5, wherein:

the first cross-sectional thickness of each fiber of the plurality of fibers is between 0.01 millimeters and 0.02 millimeters; and the second cross-sectional thickness of the at least one wire is between 0.15 millimeters and 0.25 millimeters.

21. A system comprising:

a portable article coupled to a first end of the cable structure of claim 1; and a support coupled to a second end of the cable structure.

22. The system of claim 21, wherein:

the first end of the cable structure is coupled to the portable article via an article connector component;

the second end of the cable structure is coupled to the support via a support connector component; and the cable structure is configured to conduct an electrical signal between the article connector component and the support connector component.

23. The system of claim 22, wherein the conducted electrical signal is altered when the cable structure is at least partially cut.

24. The cable assembly of claim 1, wherein the first cable subassembly comprises a plurality of aramid fibers.

25. The cable assembly of claim 24, wherein the second cable subassembly comprises at least one high-carbon steel wire.

26. The cable assembly of claim 1, wherein the second cable subassembly extends adjacent to the first cable subassembly along at least the portion of the length of the cable structure.

27. The cable assembly of claim 1, wherein:

the first cable subassembly comprises a plurality of fibers extending along the portion of the length of the cable structure;

each fiber of the plurality of fibers comprises a first cross-sectional thickness;

the second cable subassembly comprises at least one wire extending along the portion of the length of the cable structure; and each wire of the at least one wire comprises a second cross-sectional thickness that is greater than the first cross-sectional thickness.

28. The cable assembly of claim 27, wherein:

each fiber of the plurality of fibers comprises a para-aramid fiber; and each wire of the at least one wire comprises a carbon steel wire.

29. A cable assembly comprising:

a first cable subassembly extending along at least a portion of a length of the cable assembly; and a second cable subassembly extending along at least the portion of the length of the cable assembly, wherein:

the first cable subassembly comprises a plurality of fibers extending along the portion of the length of the cable assembly;

at least one fiber of the plurality of fibers comprises a first cross-sectional thickness;

the second cable subassembly comprises a plurality of wires extending along the portion of the length of the cable assembly;

the second cable subassembly comprises a plurality of wire groupings;

each wire grouping of the plurality of wire groupings comprises a sub-plurality of wires of the plurality of wires;

at least one wire of the plurality of wires comprises a second cross-sectional thickness that is greater than the first cross-sectional thickness; and at least one wire grouping of the plurality of wire groupings surrounds a cross-sectional outer periphery of at least a portion of the first cable subassembly.

30. The cable assembly of claim 29, wherein:

the first cross-sectional thickness is between 0.01 millimeters and 0.02 millimeters; and the second cross-sectional thickness is between 0.15 millimeters and 0.25 millimeters.

31. The cable assembly of claim 29, wherein the second cross-sectional thickness is at least 10 times the magnitude of the first cross-sectional thickness.

32. The cable assembly of claim 29, wherein:

the at least one fiber of the plurality of fibers comprises a para-aramid fiber; and the at least one wire of the plurality of wires comprises a carbon steel wire.

33. The cable assembly of claim 29, wherein:

the first cable subassembly comprises a plurality of fiber bundles;

each fiber bundle of the plurality of fiber bundles comprises a sub-plurality of fibers of the plurality of fibers;

each wire of the plurality of wires of the second cable subassembly extends along the portion of the length of the cable assembly adjacent to a cross-sectional outer periphery of the first cable subassembly; and the plurality of wires surrounds the cross-sectional outer periphery of the first cable subassembly.

34. The cable assembly of claim 33, wherein:

at least one fiber bundle of the plurality of fiber bundles comprises a third cross-sectional thickness; and the magnitude of the second cross-sectional thickness is within 0.02 millimeters of the magnitude of the third cross-sectional thickness.

35. The cable assembly of claim 33, wherein:

the cable assembly further comprises a third cable subassembly;

the third cable subassembly comprises a plurality of outer bundles;

at least one outer bundle of the plurality of outer bundles comprises a plurality of outer wires;

each outer bundle of the plurality of outer bundles extends along at least the portion of the length of the cable assembly and adjacent to a cross-sectional outer periphery of the second cable subassembly; and the plurality of outer bundles surrounds the cross-sectional outer periphery of the second cable subassembly.

36. The cable assembly of claim 35, wherein each outer bundle of the plurality of outer bundles comprises:

a first outer bundle subassembly comprising a plurality of outer fibers; and a second outer bundle subassembly comprising the plurality of outer wires, wherein at least one outer wire of the plurality of outer wires of the second outer bundle subassembly of a particular outer bundle extends along the portion of the length of the cable assembly and adjacent to a cross-sectional outer periphery of the first outer bundle subassembly of the particular outer bundle; and the plurality of outer wires of the second outer bundle subassembly of the particular outer bundle surrounds the cross-sectional outer periphery of the first outer bundle subassembly of the particular outer bundle.

37. A system comprising:

a portable article coupled to a first end of the cable assembly of claim 29; and a support coupled to a second end of the cable structure.

38. The cable assembly of claim 29, wherein the second cable subassembly extends adjacent to the first cable subassembly along at least the portion of the length of the cable assembly.

39. The cable assembly of claim 29, wherein:

the first cable subassembly comprises a first cut-resistant characteristic; and the second cable subassembly comprises a second cut-resistant characteristic that is different than the first cut-resistant characteristic.

40. The cable assembly of claim 29, wherein:

the first cable subassembly comprises a plurality of fiber bundles;

each fiber bundle of the plurality of fiber bundles comprises a sub-plurality of fibers of the plurality of fibers;

each wire of a particular wire grouping of the plurality of wire groupings extends along the portion of the length of the cable assembly and adjacent to a cross-sectional outer periphery of a particular fiber bundle of the plurality of fiber bundles; and the particular wire grouping surrounds the cross-sectional outer periphery of the particular fiber bundle.

41. The cable assembly of claim 40, wherein:

the particular fiber bundle of the plurality of fiber bundles comprises a third cross-sectional thickness; and the magnitude of the third cross-sectional thickness is between 3 times and 4 times greater than the magnitude of the second cross-sectional thickness.

42. The cable assembly of claim 40, wherein:

the cable assembly further comprises a third cable subassembly;

the third cable subassembly comprises a plurality of wire bundles;

each wire bundle of the plurality of wire bundles comprises a plurality of bundled wires;

each wire bundle of the plurality of wire bundles extends along the portion of the length of the cable assembly and adjacent to a cross-sectional outer periphery of the second cable subassembly; and the plurality of wire bundles surrounds the cross-sectional outer periphery of the second cable subassembly.

43. The cable assembly of claim 42, wherein:

at least one fiber bundle of the plurality of fiber bundles comprises a third cross-sectional thickness;

at least one particular bundled wire of at least one particular plurality of bundled wires of at least one particular wire bundle of the plurality of wire bundles comprises a fourth cross-sectional thickness; and the magnitude of the fourth cross-sectional thickness is within 0.02 millimeters of the magnitude of the third cross-sectional thickness.

44. The cable assembly of claim 29, wherein:

the first cable subassembly comprises a plurality of fiber bundles;

each fiber bundle comprises a sub-plurality of fibers of the plurality of fibers;

each wire grouping of the plurality of wire groupings extends along the portion of the length of the cable assembly and adjacent to a cross-sectional outer periphery of the first cable subassembly; and the plurality of wire groupings surrounds the cross-sectional outer periphery of the first cable subassembly.

45. The cable assembly of claim 44, wherein:

at least one fiber bundle of the plurality of fiber bundles comprises a third cross-sectional thickness;

the third cross-sectional thickness is between 0.25 millimeters and 0.35 millimeters; and the second cross-sectional thickness is between 0.15 millimeters and 0.25 millimeters.

46. The cable assembly of claim 44, wherein:

at least one fiber bundle of the plurality of fiber bundles comprises a third cross-sectional thickness;

at least one wire grouping of the plurality of wire groupings comprises a fourth cross-sectional thickness;

the third cross-sectional thickness is between 0.25 millimeters and 0.35 millimeters; and the fourth cross-sectional thickness is between 0.75 millimeters and 0.95 millimeter.

47. A method of forming a cable comprising:

twisting a plurality of first elements of a first bundle in a first lay direction along a longitudinal axis of the cable;

twisting, in a second lay direction along the longitudinal axis of the cable, each one of a plurality of second bundles about the twisted plurality of first elements of the first bundle, wherein each second bundle of the plurality of second bundles comprises a plurality of second elements, and wherein each second element of the plurality of second elements comprises a fiber; and twisting a plurality of third elements about the twisted plurality of second bundles in a third lay direction along the longitudinal axis of the cable, wherein the first lay direction is the opposite of the second lay direction.

48. The method of claim 47, wherein:

at least one first element of the plurality of first elements comprises a fiber; and at least one third element of the plurality of third elements comprises a wire.

49. The method of claim 47, wherein the third lay direction is the same as the first lay direction.

50. The method of claim 47, further comprising twisting a plurality of fourth elements about the twisted plurality of third elements in a fourth lay direction along the longitudinal axis of the cable.

51. The method of claim 50, wherein:

the plurality of fourth elements comprises a plurality of bundles of the fourth elements;

each bundle of the plurality of bundles is adjacent a cross-sectional outer periphery of the twisted plurality of third elements; and the twisted plurality of fourth elements surrounds the cross-sectional outer periphery of the twisted plurality of third elements.

52. The method of claim 47, wherein:

a particular first element of the plurality of first elements comprises a first cross-sectional thickness that is between 0.012 millimeters and 0.018 millimeters; and a particular third element of the plurality of third elements comprises a second cross-sectional thickness that is between 0.15 millimeters and 0.25 millimeters.

53. The method of claim 47, wherein a particular third element of the plurality of third elements comprises a first cross-sectional thickness that is at least 10 times the magnitude of a second cross-sectional thickness of a particular first element of the plurality of first elements.

54. The method of claim 47, wherein:

the plurality of first elements comprises a first cut-resistant characteristic; and the plurality of third elements comprises a second cut-resistant characteristic that is different than the first cut-resistant characteristic.

55. The method of claim 47, wherein:

each one of the plurality of second bundles comprises a plurality of fibers and a bundle longitudinal axis;

the method further comprises twisting the plurality of fibers of each particular second bundle of the plurality of second bundles in a fourth lay direction along the bundle longitudinal axis of that particular second bundle; and the fourth lay direction is the same as the first lay direction.

56. The method of claim 47, wherein:

each one of the plurality of second bundles comprises a plurality of fibers and a bundle longitudinal axis;

the method further comprises twisting the plurality of fibers of each particular second bundle of the plurality of second bundles in a fourth lay direction along the bundle longitudinal axis of that particular second bundle; and the fourth lay direction is the same as the second lay direction.

57. The method of claim 47, wherein the third lay direction is the same as the second lay direction.

* * * * *